US010124401B2

(12) United States Patent
Beckmann et al.

(10) Patent No.: US 10,124,401 B2
(45) Date of Patent: Nov. 13, 2018

(54) FEEDER INSERT

(71) Applicant: CHEMEX GMBH, Delligsen (DE)

(72) Inventors: Jürgen Beckmann, Hofgeismar (DE); Michael Biemel, Würzburg (DE)

(73) Assignee: CHEMEX GMBH, Delligsen (DE)

( * ) Notice: Subject to any disclaimer, the term of this patent is extended or adjusted under 35 U.S.C. 154(b) by 339 days.

(21) Appl. No.: 14/893,710

(22) PCT Filed: May 27, 2014

(86) PCT No.: PCT/EP2014/060980
§ 371 (c)(1),
(2) Date: Nov. 24, 2015

(87) PCT Pub. No.: WO2014/191423
PCT Pub. Date: Dec. 4, 2014

(65) Prior Publication Data

US 2016/0101461 A1 Apr. 14, 2016

(30) Foreign Application Priority Data

May 27, 2013 (DE) ..... 10 2013 209 775

(51) Int. Cl.
*B22C 9/08* (2006.01)
*B22D 35/04* (2006.01)

(52) U.S. Cl.
CPC ..... *B22C 9/088* (2013.01); *B22D 35/04* (2013.01)

(58) Field of Classification Search
CPC ..... B22C 11/10; B22C 19/00; B22C 9/00; B22C 9/088
See application file for complete search history.

(56) References Cited

U.S. PATENT DOCUMENTS 7,500,509 B2 3/2009 Powell et al.
2009/0301684 A1 12/2009 Beckmann et al.
(Continued)

FOREIGN PATENT DOCUMENTS

CN 1589186 3/2005
CN 101563177 10/2009
CN 102641994 8/2012
(Continued)

*Primary Examiner* — Kevin P Kerns
*Assistant Examiner* — Steven S Ha
(74) *Attorney, Agent, or Firm* — Duane Morris LLP; J. Rodman Steele, Jr.; Gregory M. Lefkowitz

(57) ABSTRACT

The invention describes a feeder insert (2, 2', 2'', 2''', $\mathbf{2}^{IV}$) for use for the casting of metals in vertically separable casting molds, having a first shaped element (8, 8', 8'', 8''', $\mathbf{8}^{IV}$) and a second shaped element (10) which (i) are moveable telescopically relative to one another, (ii) delimit a feeder cavity (30) for receiving liquid metal, and (iii) are designed for being position by means of a centring pin (20, 22') that can be positioned along a centring axis (28), wherein the first shaped element (8, 8', 8'', 8''', $\mathbf{8}^{IV}$) has a passage opening (18) for the liquid metal, and wherein the feeder cavity (30) is designed such that, in the case of horizontal arrangement of the centring axis (28), a predominant volume fraction of the feeder cavity (30) can be positioned above the centring axis.

13 Claims, 15 Drawing Sheets

(56) References Cited

U.S. PATENT DOCUMENTS

| | | | |
|---|---|---|---|
| 2012/0211192 | A1 | 8/2012 | Sallstrom et al. |
| 2013/0306685 | A1 | 11/2013 | Sallstrom et al. |

FOREIGN PATENT DOCUMENTS

| | | |
|---|---|---|
| CN | 202824525 | 3/2013 |
| DE | 3423220 | 1/1986 |
| DE | 8702296 | 4/1987 |
| DE | 8418911 | 11/1987 |
| DE | 202012010986 | 3/2013 |
| EP | 1184104 | 3/2002 |
| EP | 1920859 | 5/2008 |
| JP | 54-160517 | 12/1979 |

FEEDER INSERT

CROSS-REFERENCE TO RELATED APPLICATIONS

This application is a § 371 national stage entry of International Application No. PCT/EP2014/060980, filed May 27, 2014, which claims priority to German Patent Application No. 10 2013 209 775.1, filed May 27, 2013, the entire contents of which are incorporated herein by reference.

BACKGROUND OF THE INVENTION

The present invention relates to a feeder insert for use for the casting of metals in vertically separable casting moulds, having a first shaped element and a second shaped element which delimit a feeder cavity for receiving liquid metal, wherein the first shaped element has a passage opening for the liquid metal and is designed for mounting on a mould pattern or a pivotable mould plate.

BRIEF SUMMARY OF THE INVENTION

Feeder inserts, also referred to as feeders, are used primarily in the production process of the casting of metals in casting moulds. Feeder inserts normally form a cavity, wherein the feeder insert is surrounded by a mould material used for producing the casting mould. The casting chamber provided within the casting mould for receiving the liquid metal has a passage to the feeder cavity, into which a partial amount of the liquid metal poured into the casting mould then enters during the casting process. It is the intention for the liquid metal that has thus passed into the feeder to be able to flow back into the casting mould during the solidification process (which is associated with a contraction of the cast metal) in order, there, to compensate for the shrinkage of the casting down until the solidus temperature is reached.

To ensure that the metal situated in the feeder flows back out, it must be ensured that the metal in the feeder insert remains in the liquid state while the metal in the interior of the casting mould is already solidifying or has already partially solidified to form the casting. For this purpose, at least a part of the feeder insert is normally composed of an insulating and/or exothermic material, wherein, as liquid metal enters the feeder insert, an exothermic material is ignited owing to the prevailing temperatures. From this moment onward, an exothermic reaction then takes place within the material of the feeder insert automatically, as a result of which exothermic reaction heat energy is supplied to the metal situated in the feeder over a certain period of time, and the metal in the feeder cavity and in the transition region to the casting cavity of the casting moulds is kept in the liquid state.

Owing to considerably increased demands for productivity also in the casting sector, possibilities have been sought for automating mould production and thus enabling casting moulds for castings to be produced in large unit quantities. For this purpose, automated, vertical green sand moulding installations (for example Disamatic moulding machines from DISA Industries A/S) have for example been developed in which, for example, a first pattern half is installed on an exclusively linearly adjustable press piston. An associated second pattern half is normally installed on a pivotable mould plate which is moved back and forth between a horizontal orientation, in which said mould plate is for example equipped with a feeder, and a vertical orientation. In its vertical working position, the pivotable mould plate is commonly likewise displaceable, preferably parallel to the first pattern half. In the case of vertically separable casting moulds, by means of which relatively thin-walled castings can be produced, there is for example the problem of ensuring refeeding of for example insulated, heavy casting sections. To ensure the refeeding of such insulated regions, feeder inserts are used whose feeder longitudinal axes are oriented approximately perpendicular to the pivotable mould plate, such that the feeder longitudinal axis of a feeder insert arranged in this way runs approximately horizontally during the casting process. A feeder insert of said type has a shaped element which can be placed in contact with a mould pattern or a pivotable mould plate and which is equipped with a passage opening for the liquid metal.

The publication DE 202011103718 U1 has disclosed a feeder insert for use for the casting of metals in vertically separable casting moulds, which feeder insert has a first shaped element and a second shaped element which delimit the feeder cavity for receiving the liquid metal. The first shaped element has a mounting region for mounting on a mould pattern or a pivotable mould plate. The mounting region is provided with a passage opening for the liquid metal, wherein the central axis of the passage opening is arranged offset with respect to the central region of the first shaped element. Owing to the eccentrically arranged passage opening, the liquid metal, during the casting process, enters the feeder in a lower region and, during the use of the feeder insert, rises within the feeder insert approximately vertically with respect to the feeder longitudinal axis. In this way, it is intended to achieve improved re-feeding of the metal during the shrinkage process. In order that the forces that act on the feeder insert during the compaction of the mould material that forms the casting mould can be better absorbed, the feeder insert known from DE 202011103718 U1 has, on its first shaped element, a compressible mounting region which is irreversibly deformed during the compaction of the mould material. Depending on the extent of deformation, the force that presses the mounting region against the mould plate may be relatively low after the compaction of the mould material, such that under some circumstances, mould material may infiltrate into the region between the mounting region and the mould pattern. Furthermore, there is the risk that, during the compression of the mounting region and the associated decrease in distance between the first shaped element and the mould pattern or the pivotable mould plate, an excessively high compaction force acts on the feeder insert, leading to fracture of the second shaped element, which is commonly composed of an exothermic material.

DE 34 23 220 A1, and DE 84 18 911 U1 from the same applicant, disclose a feeder insert for use for the casting of metals in horizontally separable casting moulds, which feeder insert comprises a first shaped element and a second shaped element. The first shaped element forms a feeder base for lateral mounting on a mould pattern, wherein the first shaped element is received in the mould material of the lower mould half below the parting plane between the upper mould half and the lower mould half. Here, the first shaped element has a casing composed of an insulating and/or exothermic feeder material. The second shaped element is arranged in the upper mould half of the casting mould and, when the upper and lower mould halves are brought together to form a casting mould, is brought into contact with the first shaped element, which forms the feeder base. With the second shaped element mounted on top of the first shaped element, a feeder cavity is formed, the predominant volume fraction of which is arranged above the horizontally running passage opening of the first shaped element. The compaction of the mould material basically takes place in each case separately during the production of the individual mould halves in the top and bottom boxes.

The publication DE 87 02 296 U1 has likewise disclosed a feeder insert for use for the casting of metals in horizontally separable casting moulds. The feeder insert again has a first shaped element, formed as a feeder lower part, and a second shaped element, formed as a feeder upper part. The separation between the first and second shaped elements is provided in particular in the region of the parting plane between the upper and lower mould halves. The passage opening to the casting is in this case formed at least through a region of the second, upper shaped element. In the second shaped element, above the passage opening which in particular runs horizontally during use, there is provided a melt reservoir for the supply of liquid metal during the solidification of the casting.

Taking the above-mentioned problem as a starting point, the problem addressed by the invention is that of specifying a feeder insert which withstands high compaction pressures during the production of the casting mould in a vertically separable casting mould, and during the use of which the risk of infiltration of mould material between mounting region and mould pattern is reduced.

The invention solves the problem on which it is based with a feeder insert of the type mentioned in the introduction in that the first shaped element and the second shaped element are moveable telescopically relative to one another and are designed for being positioned by means of a centring pin that can be positioned along a centring axis, wherein the feeder cavity delimited by the first and second shaped elements is designed such that, in the case of horizontal arrangement of the centring axis, a predominant volume fraction of the feeder cavity can be positioned above the centring axis.

The invention thus relates to a feeder insert which is suitable for use for the casting of metals in vertically separable casting moulds which are produced using vertical moulding installations such as, for example, Disamatic moulding machines from DISA Industries A/S. The feeder insert comprises at least one first shaped element and one second shaped element which delimit the feeder cavity for receiving liquid metal. The first shaped element has a passage opening for the liquid metal, which passage opening normally serves for mounting on a mould pattern or a pivotable mould plate. As the metal is poured into the casting mould, the liquid metal passes into the feeder insert via the passage opening; the liquid metal then flows back from the feeder cavity into the casting mould through the passage opening during the shrinkage process (until the casting has completely solidified). The centring axis of the feeder insert, which typically coincides with the central axis of the passage opening, is arranged so as to be offset downward relative to the central region of the first shaped element, in particular if the feeder insert is used in a vertical moulding installation (that is to say when the centring axis has assumed a horizontal orientation). The metal-conducting connection between the casting mould and the feeder cavity is thus arranged in a lower region of the feeder insert, such that the predominant volume fraction of the feeder cavity is positioned above the centring axis (and thus typically at the same time above the central axis of the passage opening). The first shaped element and the second shaped element of a feeder insert according to the invention are designed to be moveable telescopically relative to one another in sections, such that one of the shaped elements, preferably the second shaped element, during the compaction of the mould material that ultimately virtually completely surrounds or encloses the feeder insert, can yield to the pressure acting predominantly on the second shaped element. During the telescopic displacement relative to one another, a relative movement takes place between first shaped element and second shaped element, wherein the second shaped element is preferably pushed, in sections, over the first shaped element, which is generally not deformable, in the direction of the centring axis, wherein the first shaped element bears, or is supported, by way of its mounting region and the passage opening formed therein, against the mould pattern or the pivotable mould plate.

The invention is based on the realization that, with a telescopic feeder insert, the first and second shaped elements of which can be moved telescopically relative to one another at least over a section, it is possible, owing to the friction force between the shaped elements, for an adequately high pressure force to be generated between the mounting region of the first shaped element and (for example) the mould pattern, as a result of which reliable abutment of the first shaped element against the mould pattern is ensured during the compaction of the mould material. Owing to the movability of the second shaped element relative to the first shaped element, it is furthermore ensured that, by contrast to a feeder insert with compressible mounting region on the first shaped element, the second shaped element can easily deflect in the direction of the mould pattern if an excessive compaction pressure acts on the feeder insert. Likewise intense compaction of the mould material between the first shaped element and, for example, the mould pattern, such as is encountered in the prior art owing to the first shaped element moving toward the mould pattern, resulting in a relatively high pressure acting on the feeder insert small sides, is thus advantageously avoided. Owing to the first shaped element being fixed with respect to the mould pattern, the risk of destruction of the feeder insert during the compaction process is reduced considerably. The wall thicknesses of the first and second shaped elements are thus selected such that they can ensure the required insulation or thermal output for keeping the metal in the feeder cavity in the liquid state. Furthermore, owing to the preferred configuration of the feeder cavity with its volume fraction for receiving the liquid metal positioned above the centring axis during use of the feeder insert, it is ensured that, during the solidification and the associated shrinkage of the casting to be produced, there is, within the feeder cavity, an adequate amount of liquid metal that can flow in the direction of the casting mould.

A further aspect of the invention relates to a shaped element for use as a first or second shaped element of a feeder insert according to the invention (as defined above or below). With a shaped element designed according to the invention, which is used as a first or second shaped element of a feeder insert according to the invention, it is the case during the compaction of the mould material that reliable sealing is ensured between the mounting region of the first shaped element and, for example, the mould pattern or the pivotable mould plate, wherein the feeder insert easily withstands high compaction pressures, and thus a high level of casting quality can be ensured. At the same time, with the volume fraction formed above the centring axis, a relatively large reservoir is formed for the metal that is to be kept in the liquid state.

In a further embodiment, as an alternative or in addition to the telescopic design of the shaped elements according to the invention, provision is made for at least one ventilation opening for ventilating the feeder cavity, which is delimited by the first and second shaped elements, to be arranged on the first shaped element (as a component of the feeder insert according to the invention). The ventilation opening should be arranged or positioned above the centring axis in the first shaped element in the case of a horizontal arrangement of the centring axis, whereby the casting process can be performed at a correspondingly high speed without the risk of the feeder being inadequately filled with liquid metal owing to a build-up of air in the interior thereof.

A further aspect of the invention relates to a kit for producing a feeder insert according to the invention (as defined above or below), comprising a first shaped element and a second shaped elements. A kit of said type thus comprises a first shaped element and a second shaped element which can be assembled to form a feeder insert according to the invention. Here, a given first shaped element can be combined with second shaped elements of different design, and a given second shaped element can be combined with first shaped elements of different design.

In the feeder insert according to the invention, for the positioning of the centring pin, there is provided on the second shaped element a conically running wall section and/or a cylindrical or non-cylindrical recess for the pin tip. By means of the wall section which is formed on the second shaped element and the (preferably cylindrical) recess for the pin tip of the centring pin, simplified mounting onto the centring pin, or mounting of the feeder insert on the mould pattern, is achieved. It is preferably provided that the at least one conically running wall section and the recess are formed on the inner contour of the second shaped element. A cylindrical recess is preferably arranged concentrically with respect to the centring axis, whereby exact orientation of the feeder insert mounted on the centring pin with respect to the mould pattern or the pivotable mould plate, which are preferably used in conjunction with vertically separable casting moulds, is ensured. The recess preferably corresponds in form-fitting fashion to the outer contour of a centring pin tip that can be inserted into the recess; a corresponding centring pin is preferably included in a kit according to the invention.

It is preferable for a ventilation opening for ventilating the feeder cavity to additionally be arranged in the first shaped element, which ventilation opening, in the case of a horizontal arrangement of the centring axis, can be positioned above the centring axis. By means of the ventilation opening, it is advantageously ensured during the operation of the feeder insert that, as the liquid metal is poured into the casting mould and enters or passes into the feeder insert, no air cushion that could prevent the liquid metal from rising within the feeder cavity forms in the feeder cavity, in particular in the volume fraction that can be positioned above the centring axis. Thus, the feeder cavity contains an adequate amount of liquid metal that can flow back into the casting mould during the shrinkage of the solidifying casting. The ventilation opening is preferably arranged in the first shaped element of the feeder insert, the position of which first shaped element relative to the mould pattern or the pivotable mould plate does not change during the compaction of the mould material. The ventilation opening is for example arranged or formed in the wall section that delimits the feeder cavity in the upward direction during use (that is to say during casting), wherein the ventilation opening has a central axis which then preferably runs at an angle of between 0° and 90° with respect to the centring axis of the feeder insert. Here, the described formation of the ventilation opening in the first shaped element of a feeder insert is an independent aspect of the invention which should also be considered independently of the telescopic movability of the first and second shaped elements relative to one another. A further independent aspect of the invention thus relates to a feeder insert for use for the casting of metals in vertically separable casting moulds, having a first shaped element and a second shaped element which delimit a feeder cavity for receiving liquid metal and are designed for being positioned by means of a centring pin that can be positioned along a centring axis, wherein the first shaped element has a passage opening for the liquid metal (the central axis of which passage opening preferably coincides with the centring axis), and the first shaped element additionally has a ventilation opening for ventilating the feeder cavity; in the case of horizontal arrangement of the centring axis, the ventilation opening can preferably be positioned above the centring axis, and the feeder cavity is preferably designed such that, in the case of horizontal arrangement of the centring axis, a predominant volume fraction of the feeder cavity can be positioned above the centring axis. This independent aspect of the invention can be combined with the other aspects of the present invention; that which has been stated in the corresponding text passages applies correspondingly with regard to preferred combinations. Alternatively or in addition, a ventilation opening is arranged in the second shaped element of the feeder insert.

It is preferable for the ventilation opening to be in the form of a ventilation duct, wherein the ventilation duct preferably, in sections or over its entire length, runs parallel to the centring axis. By means of a ventilation duct which, at least in sections, runs horizontally when the feeder insert is used in a vertical moulding installation, additional coupling to a structural or attachment part arranged on the moulding plate is easily possible. It is preferable for a structural or attachment part of said type to be arranged on the pivotable mould plate and to form a mould part extending along a section of the mould plate, which results in there being a preferably vertically running ventilation duct in the pivotable mould plate during casting operation. By means of the attachment part, therefore, a mould part is formed for the ventilation duct running preferably vertically within the casting mould to be produced, and at the same time, a mechanical coupling to the mould plate is created, by means which of the feeder insert according to the invention is additionally fixed in position with respect to the mould pattern and the mould plate. Furthermore, the configuration of the ventilation opening as a duct ensures a rapid escape of the air situated in the feeder insert during the casting process.

A feeder insert according to the invention is preferable in which the second shaped element is formed from an exothermic feeder material or comprises exothermic feeder material at least in sections, and/or the first shaped element is formed from exothermic feeder material or comprises exothermic feeder material at least in sections. With the use of exothermic feeder material, a high level of efficiency and in particular a good sealing feed during the casting process are achieved, because, by means of the exothermic feeder material, the metal situated in the feeder insert can be kept in the liquid state over a relatively long period of time. Regions of, for example, the second shaped element which are moved over the outside of the first shaped element may also be formed from an insulating feeder material instead of an exothermic feeder material, which insulating feeder material advantageously reduces the release of heat from the feeder insert. It is however also simply possible for a moulding sand, in particular quartz sand, bound using a binding agent to be used as a feeder material. It is however often preferable for an exothermic material to be used for forming at least parts of the shaped elements. Certain regions of the feeder insert may be formed from different materials with different characteristics (exothermic or insulating). Alternatively, the shaped elements may each be formed from a homogenous material mixture with exothermic and insulating constituents.

For certain purposes, a feeder insert according to the invention is advantageous in which the first shaped element is formed from insulating feeder material or comprises insulating feeder material at least in sections and/or the second shaped element is formed from an insulating feeder material or comprises insulating feeder material at least in sections. In an alternative embodiment of the feeder insert, it is preferably provided that the second shaped element is formed from an exothermic feeder material or comprises exothermic feeder material at least in sections and/or the first shaped element does not comprise an exothermic feeder material and is preferably formed from insulating feeder material or comprises insulating feeder material at least in sections or is formed from or comprises a material selected from the group comprising metals, plastics, cardboards, the mixtures thereof and the composite materials thereof. In a further alternative embodiment of the feeder insert according to the invention, the second shaped element is formed from insulating feeder material or comprises insulating feeder material at least in sections and/or the first shaped element is formed from exothermic feeder material or comprises exothermic feeder material at least in sections or is formed from or comprises a material selected from the group comprising metals, plastics, cardboards, the mixtures thereof and the composite materials thereof.

Instead of commercially available feeder materials, the first shaped element of a feeder insert according to the invention may also be composed of other materials which are preferably selected from the group comprising metals, plastics, cardboards, the mixtures thereof and the composite materials thereof.

In a further alternative embodiment of the feeder insert according to the invention, the second shaped element is formed from an exothermic or insulating feeder material or comprises exothermic or insulating feeder material at least in sections and/or the first shaped element is formed from or comprises a material selected from the group comprising metals, plastics, cardboards, the mixtures thereof and the composite materials thereof. As material for the first shaped element, it is thus possible to optionally use exothermic or insulating materials and metals, plastics or cardboards or mixtures or composite materials composed of metals, plastics and/or cardboards.

It is preferable for exothermic and insulating feeder materials to be used for forming the second shaped element. The material selection for the first and second shaped elements is, in practice, performed individually and with consideration being given to the task to be performed in each case. The selection of the material for the first shaped element may be performed independently of the selection of the material for the second shaped element, if the specific intended use of the feeder insert according to the invention does not necessitate any coordination.

In an alternative embodiment of the feeder insert according to the invention, the first shaped part preferably forms a breaker core. The use of a breaker core is advantageous in particular in conjunction with the formation of the first shaped part, or of a sub-element of the first shaped element, from a material which is metal or comprises a metal.

A preferred embodiment of the feeder insert provides that the first shaped element is in one piece or is composed of two assembled sub-elements which are positionally stable relative to one another or movable telescopically relative to one another, wherein the first sub-element comprises the footprint surface of the feeder insert and the second sub-element is designed for connecting to the second shaped element. In the case of a shaped element of the one-piece form, the mounting region for mounting on the mould pattern or on the mould plate and the connecting part corresponding to the second shaped element are formed from a single structural part. In the case of a two-part configuration of the first shaped element, the connecting region is formed from one sub-element and the mounting region of the feeder insert is formed preferably from a metallic sleeve (as a further sub-element). As described in EP 2 097 193 A, to which reference is hereby made, it is the case in a first embodiment that the first sub-element is a tubular element which, in the shipped state, is pushed to varying extents into the second sub-element. In some cases, it is advantageous for the tubular first sub-element not to be pushed to the maximum extent into the second sub-element in the shipped state, such that said first sub-element is pushed further into the second sub-element at a later point in time, for example after the arrangement of a corresponding feeder insert on a mould pattern or on a pivotable mould plate, and during the compaction of the mould material that ultimately virtually completely surrounds the feeder insert. An alternative embodiment provides a positionally fixed connection between the tubular first sub-element and the second sub-element of the first shaped element. A movement of the two sub-elements is then not possible or not provided. This advantageous embodiment of the invention can be combined in each case with the independent aspect of the present invention. That which has been stated in the corresponding text passages applies correspondingly in each case with regard to preferred combinations.

The first shaped element has a surface which faces toward the mould pattern or the pivotable mould plate and which preferably runs parallel or obliquely with respect to the pivotable mould plate. The distance between the preferably obliquely running surface and the mould pattern or the mould plate preferably increases at least in sections proceeding from the mounting region or the centring axis of the feeder insert.

It is preferable if, on the first shaped element and/or on the second shaped element, there are arranged holding elements by means of which the first shaped element and the second shaped element are held in an initial position, wherein the holding elements are designed so as to be severed or deformed during the telescopic displacement (as the first and second shaped elements are moved telescopically relative to one another). By means of holding elements, the first and second shaped elements are held in a predefined arrangement relative to one another as they are mounted onto a mould pattern or a mould plate or pushed onto a centring pin arranged on the mould pattern or mould plate. As disclosed in EP 1 184 104 A, the holding elements are preferably integral constituent parts of the respective shaped element, wherein the holding elements are integrally formed on the respective shaped element without additional steps during the production of said respective shaped element. The holding elements, which are for example projections, encircling standing rings or pins projecting perpendicularly from the inner or outer contour, normally each have only small connecting surfaces with respect to the rest of the respectively associated shaped element.

The first shaped element preferably comprises external surface sections which adjoin or bear against internal surface sections of the second shaped element and which, during the telescopic displacement of the shaped elements one inside the other or relative to one another, prevent or impede lateral tilting of the first shaped element relative to the second shaped element. On the external surface sections or the outer contour of the first shaped element and/or on the internal surface sections or the inner contour of the second shaped element there are preferably formed guide surfaces by which the two shaped elements are advantageously guided relative to one another and slide directly on one another. The guide surfaces are preferably designed to ensure a uniform relative movement between the first and second shaped parts, such that preferably, during the compaction of the mould material and the resulting movement of the second shaped element over at least a section of the first shaped element, jamming of the second shaped element is prevented. For this purpose, the first and second shaped elements preferably have adequately large guide surfaces, or guide surfaces which overlap one another to an adequate extent. With the formation of the guide surfaces on, for example, surface regions of the outer and inner contours of the shaped elements that are held so as to be movable relative to one another, a structurally simple configuration of the guide surfaces on the respective components is realized. If the guide surfaces are formed on surface regions of the inner contour of the second shaped element, the second shaped element is pushed over the first shaped element of the feeder insert, whereby a section of the first shaped element is then received in the second shaped element. The extent of the movement of the two shaped elements relative to one another is in this case dependent in particular on the compaction pressures acting on the mould material during the compaction with the vertical moulding installations. Instead of the inner and outer contour sliding directly on one another, the first shaped element and/or the second shaped element may be equipped with guiding ribs which project outward from the inner contour or which project inward from the outer contour, such that sliding guidance is realized.

A feeder insert according to the invention is preferable in which the first shaped element has, as means for achieving and/or maintaining a predetermined orientation of the feeder insert relative to a mould plate, a passage opening with a non-circular cross section preferably selected from the group composed of overall, unround, flattened circle, flattened oval, triangular, tetragonal or polygonal, and/or one or more additional recesses or openings for receiving a second centring pin, wherein the one or more recesses or openings preferably run parallel to the centring axis, and/or one or more spacers on the side facing toward the mould plate. A passage opening which has, for example, an asymmetrical or unround cross section makes it possible to form an advantageously acting means for preventing rotation of the feeder insert relative to the mould pattern or the pivotable mould plate. The passage opening, which is preferably of non-cylindrical form, preferably corresponds, over the full circumference, to an outer surface of a centring pin which is arranged on the mould pattern or on the mould plate and onto which the feeder insert is mounted or pushed. At the same time, the first shaped element preferably has a passage opening which is flattened on one side, such that the feeder insert can preferably assume only a single mounted position or orientation when mounted on the mould pattern or the mould plate (key-lock principle). This prevents the feeder insert from inadvertently assuming an incorrect orientation within a vertically separable casting mould to be produced, and it is achieved that, in fact, the predominant volume fraction of the feeder cavity is preferably positioned above the (then horizontally running) centring axis during the use of the feeder insert. This advantageous embodiment of the invention can be combined in each case with the independent aspects of the present invention; that which has been stated in the corresponding text passages applies correspondingly in each case with regard to preferred combinations.

The feeder insert according to the invention preferably has, as means for achieving and/or maintaining a predetermined orientation of the feeder insert relative to a mould plate, one or more additional recesses or openings for receiving a second centring pin, wherein the one or more recesses or openings preferably run parallel to the centring axis. By forming at least one or more additional recesses or openings on the first shaped element, receptacles for at least one second centring pin are created, whereby the positional stability or orientation of the feeder insert relative to the centring axis and the mould pattern or the pivotable mould plate is advantageously improved. In particular, the additional recess or opening on the first shaped element faces toward the mould pattern or the pivotable mould plate and has, for example, a conical shape. Said additional recess or opening preferably runs parallel to the centring axis. Recesses or openings which extend from the outer side of the first shaped element into the feeder cavity are preferred. Advantageously simple mounting of the feeder insert onto a centring pin is thus achieved, said pin being part of a kit, to which the invention likewise relates, composed of a feeder insert according to the invention and of a centring pin for receiving the feeder insert with a form fit. It is preferably the case that, after the compaction of the mould material and the subsequent removal of the centring pin from the opening, an additional recess or opening, preferably running parallel to the centring axis, simultaneously serves to realize ventilation from the feeder cavity. For this purpose, the additional recess or opening for receiving the at least one further centring pin should preferably, in the case of the feeder insert being used in a vertical moulding installation or in the case of a horizontal orientation of the centring axis of the feeder insert, be formed above the centring axis, preferably at the highest possible position on the first shaped element.

In preferred refinements of the feeder insert according to the invention, one or more spacers are provided on that side of the first shaped element which faces toward the pattern plate, said spacers being configured for example as cylindrical studs or pegs. The spacers have the task, during the compaction of the mould material, of realizing fixed positioning of the mould plate or mould pattern relative to the first shaped element, which is to be mounted on the mould pattern or mould plate. When the first shaped element has been fixed in position, the second shaped element is likewise fixed in position as a result, specifically for example owing to the corresponding guide surfaces, which are preferably in contact with one another, of the first and second shaped elements. Alternatively or in addition to one or more spacers on that side of the first shaped element which faces toward the mould plate, the first shaped element may, on the inner side, have an abutment surface which extends over for example at least half of the height of the first shaped element, preferably parallel to the centring axis, and which is designed and provided for being placed in contact with a support surface of a centring pin that can be arranged on the pattern plate or the mould pattern. The abutment surface on the inner side is preferably formed so as to be in alignment, or in a plane, with a surface region of a soffit surface that delimits the passage opening. The first shaped element is thus alternatively or additionally supported by way of its abutment surface on the inner side against a centring pin (that normally projects perpendicularly from the mould pattern or from the mould plate). All of the above-mentioned means for achieving and/or maintaining a predefined orientation of the feeder insert relative to the mould plate may each be provided individually or in combination with one another on a feeder insert according to the invention. Accordingly, the feeder insert according to the invention may have one, two or even all of the stated means. This advantageous embodiment of the invention can be combined in each case with the independent aspects of the present invention; that which has been stated in the corresponding text passages applies correspondingly in each case with regard to preferred combinations.

It is preferable if the second shaped element has, on the inside at its end situated opposite the passage opening (its end that receives the pin tip), one or more integrally formed ribs or wall sections which divide up the feeder cavity into chambers. By means of a rib or a wall section which projects from the inner side and which is for example configured as a so-called Williams strip or Williams wedge, premature formation of a casting skin on the surface of the liquid metal in the region above the centring axis of the feeder insert is counteracted, whereby the effect of said feeder insert, specifically that of keeping the liquid metal situated therein in the liquid state, is improved. It is preferable for in each case at least one rib which projects into the feeder cavity to be provided on the first shaped element and on the second shaped element. In the case of horizontal arrangement of the centring axis, the ribs are arranged on an inner wall section, arranged above the centring axis, of the first and second shaped elements and preferably extend in a plane running parallel to, preferably through, the centring axis. The ribs, which are also known under the designations "Williams strip" or "Williams wedge", come to lie preferably congruently on top of or over one another in the event of corresponding compression of the mould material and the associated pushing-together of the two shaped elements of the feeder insert. The one or more ribs may either be a separately formed inlay part for insertion into the feeder cavity of the feeder insert, or may be formed as a part which is integrally formed on the inner contour of the first and second shaped elements. An integrally formed rib is produced during the moulding of the shaped element according to the invention, and comprises for example a prismatic shape, wherein the rib is arranged on the inner surface of the feeder insert according to the invention such that said rib is arranged at the upper end of the feeder cavity during use (that is to say during casting operation).

A kit according to the invention preferably comprises not only a first shaped element and a second shaped element but also a centring pin for being received in form-fitting fashion by the feeder insert. The feeder insert (which in turn is formed from first and second shaped elements) can preferably be pushed over the centring pin or mounted onto the centring pin. The centring pin for receiving or holding the feeder insert has a centring pin foot with a shape which is matched in particular to the soffit surface of the passage opening in the first shaped element. The cross section of the centring pin foot is, corresponding to the passage opening, preferably formed so as to be not cylindrical but preferably selected from the group composed of overall, unround, flattened circle, flattened oval, triangular, tetragonal or polygonal. In this way, a means for preventing rotation between the centring pin and feeder insert is realized, and furthermore, the centring pin and the shaped elements are preferably designed such that the feeder insert and the centring pin can assume only a single position relative to one another, in which the first shaped element, and the second shaped element that corresponds to the first shaped element, can be pushed onto the centring pin (key-lock principle). Accordingly, a preferred orientation of the feeder insert on the pattern plate is ensured, and incorrect handling is advantageously prevented. In addition to the centring foot, which is matched in terms of shape to the passage opening, the centring pin has a centring tip whose shape corresponds to the inner contour of a recess provided, for the purpose of receiving the pin tip, on the second shaped element.

A further aspect of the present invention relates to a method for the casting of metals in an installation with pivotable mould plate, having the following steps: mounting a feeder insert according to the invention (as defined above or below) on a mould pattern with centring pin, which mould pattern is arranged on a pivotable mould plate, or directly on a pivotable mould plate with centring pin; pivoting the mould plate with the feeder insert mounted thereon such that the centring axis of the feeder insert passes into a horizontal orientation and then a predominant volume fraction of the feeder cavity is positioned above the centring axis. Pivotable mould plates of said type are preferably used for the production of castings in vertically separable casting moulds. The invention is based inter alia on the realization that, in a process of said type, the centring axis is oriented horizontally and the liquid metal can then rise in that volume fraction of the feeder cavity which is predominantly situated above the centring axis. Said volume fraction of the feeder insert, which is situated higher than the passage opening during casting operation, thus forms, during the solidification of the casting to be produced, a supply reservoir from which the metal, which is kept in the liquid state, can flow into the casting mould. With the ventilation opening that is preferably provided in the first shaped element, optimum ventilation of the casting mould and of the feeder insert is ensured during the casting process, such that the pouring of the liquid metal into the casting mould can be performed in a relatively short time. Disadvantageous air inclusions, which have an adverse effect on the feed volume within the feeder insert, can advantageously be eliminated by way of the ventilation opening. To ensure ventilation during casting operation, there is for example provided on the pivotable mould plates a spacer with a centring pin, which projects perpendicularly through the at least one ventilation opening in the first shaped element, and with structural or attachment parts, which are coupled to the spacer. The structural or attachment parts preferably likewise run in a vertical orientation (in the case of a horizontal orientation of the centring axis) and are arranged at that location on the mould plate where a ventilation duct for the discharge of air from the feeder insert is positioned during later casting operation.

The method described above characterizes a part of a casting process which preferably comprises, as further steps: provision of a feeder insert according to the invention, pouring mould material into the mould machine such that the outer wall of the feeder insert is brought into contact with the mould material, compaction of the mould material, wherein the second shaped element is displaced relative to the first shaped element, wherein, during the movement of the second shaped element relative to at least a part of the first shaped element, the position of the first shaped element with respect to the mould plate or with respect to the mould pattern is fixed. The feeder insert according to the invention is preferably mounted on the mould pattern and/or the mould plate by hand or by machine.

The invention will be described in more detail below on the basis of multiple exemplary embodiments, from which further inventive features will emerge, and with reference to the appended figures, in which:

DETAILED DESCRIPTION OF THE INVENTION

Figure 1A:
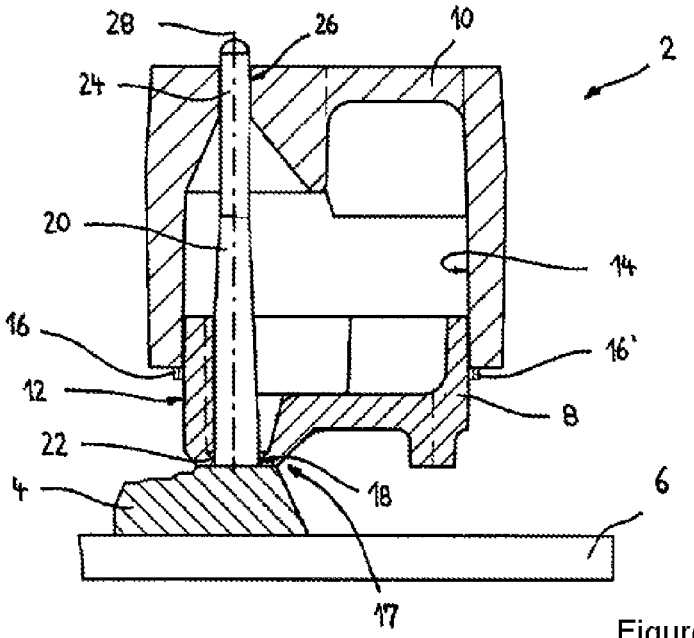
FIGS. 1*a* and 1*b*: show views of a first exemplary embodiment of a feeder insert according to the invention in section.

FIG. 1*a* shows a feeder insert 2 according to the invention in its initial arrangement on a section of a mould pattern 4, wherein the section of the mould pattern 4 for the casting to be produced is mounted or arranged on a mould plate 6 arranged in a horizontal orientation. The feeder insert 2 comprises a first shaped element 8 and a second shaped element 10 which are designed to be moveable telescopically relative to one another. To ensure reliable movement of the first shaped element 10 and second shaped element relative to one another, the shaped elements 8, 10 have guide surfaces 12, 14 which can be brought into direct contact with one another. The guide surfaces 12 of the first shaped element 8 are formed by the outer contour of the latter, and the guide surfaces 14 of the second shaped element 10 are formed by the inner contour of the latter. In order that the first and second shaped elements 8, 10 initially remain in their initial arrangement, holding elements 16, 16' are arranged on the first shaped element, which holding elements impede the shaped elements from sliding one inside the other or one over the other prematurely. The feeder insert 2 is positioned on the section of the mould pattern 4 with the aid of a centring pin 20. The centring pin 20 is arranged fixedly on the mould pattern 4. The first shaped element 8 furthermore has a mounting region 17 for mounting on the mould pattern 4, said mounting region having a passage opening 18 which corresponds in form-fitting fashion to a centring pin foot 22 of the centring pin 20. The centring pin 20 furthermore has a centring pin tip 24 over which a recess 26 of the second shaped element 10 can be pushed such that the second shaped element is held in position after being pushed on. The passage opening 18 and the recess 26 have central axes running coaxially with respect to one another, wherein the feeder insert 2 is designed for being positioned along a centring axis 28 formed by the centring pin 20.

Figure 1B:
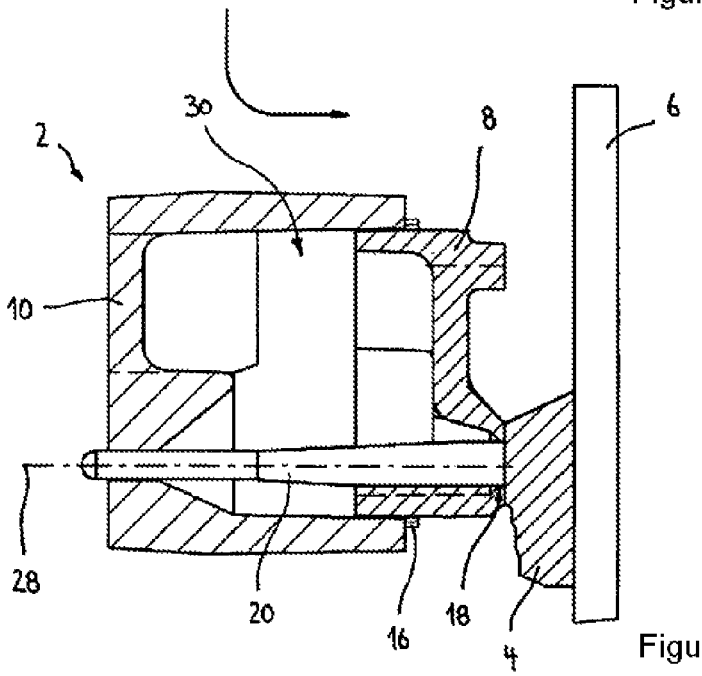

In FIG. 1*b*, the pivotable mould plate 6 has been moved into a vertical arrangement, such that the centring axis 28 is in a horizontal orientation. A feeder cavity 30 is formed by means of the first and second shaped elements 8, 10 of the feeder insert, wherein, in the case of horizontal arrangement of the centring axis (as shown in FIG. 1*b*), a predominant volume fraction of the feeder cavity 30 is arranged above the centring axis 28. Thus, at the same time, the predominant fraction of the feeder cavity 30 is arranged above the passage opening 18, such that, during the casting process, in particular during the solidification process, a supply of metal that is still in the liquid state is reliably ensured from the feeder insert to the casting mould. To maintain a positionally fixed orientation of the feeder insert 2 relative to the mould pattern 4 or the mould plate 6 during the compaction of the mould material around the feeder insert, the first shaped element 8 additionally has an abutment surface 60 (FIG. 6) which is supported on a support surface 62 of the central part 74 of the centring pin 20 (FIG. 10).

Figure 2A:
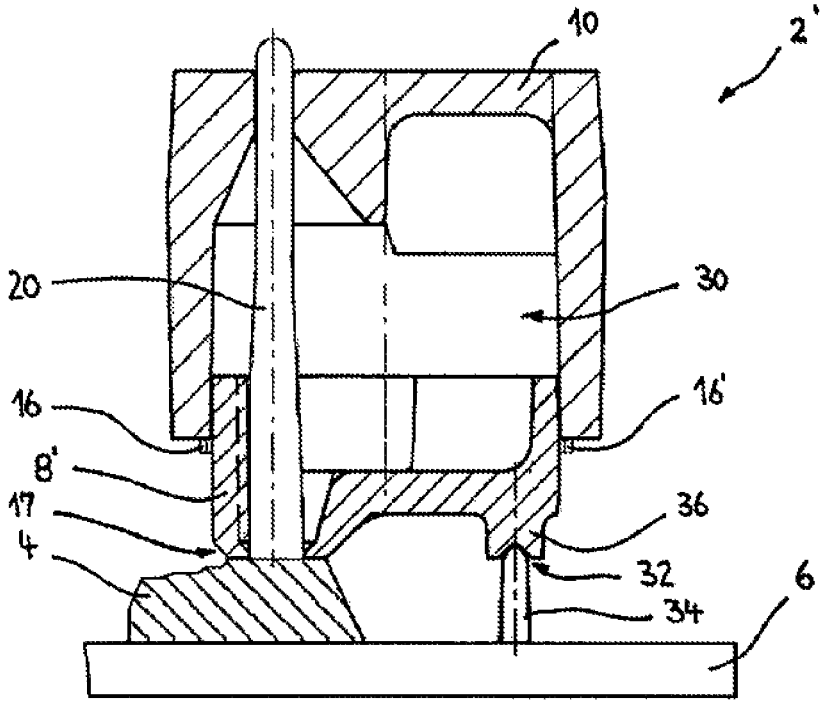
FIGS. 2*a* and 2*b*: show views of a second exemplary embodiment of a feeder insert according to the invention arranged on a mould pattern.
Figure 2B:
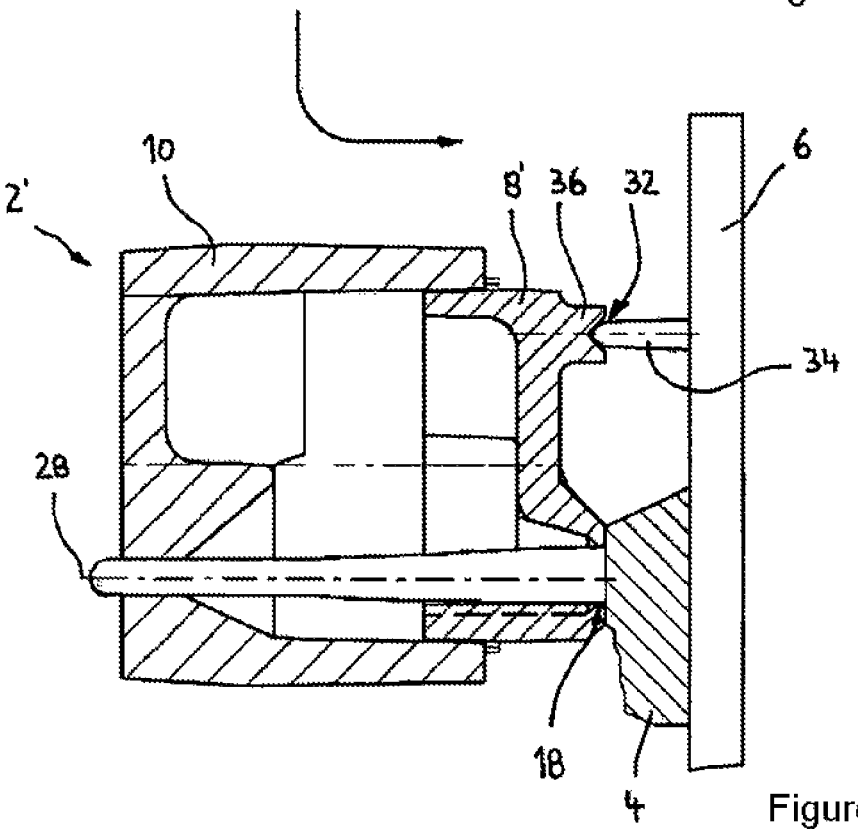

FIGS. 2*a* and 2*b* show a second exemplary embodiment of a feeder insert 2' with a first shaped element 8' and the second shaped element 10, which, in the same way, are arranged on a section of the mould pattern 4 with the aid of the centring pin 20. To improve the positioning of the feeder insert 2' relative to the mould pattern 4 or relative to the mould plate 6, the first mould shaped element 8' has, on its side facing toward the mould plate 6 and spaced apart from its passage opening 18, an additional centring recess 32 which can be placed in contact with a tip of a second centring pin 34. A means for preventing rotation of the feeder insert about the centring axis 28 is thus formed. The centring recess 32 is formed or arranged on a stud or peg 36 which projects in the direction of the mould plate. FIG. 2*b* shows the feeder insert 2' with horizontally running centring axis in its arrangement on the vertically running mould plate 6. The use of at least one second centring pin 34, which also perform the function of a spacer, additionally has the advantage that, during the compaction process that is not illustrated in any more detail here, the first shaped element 8' is now supported in the direction of the mould plate 6 by way of at least two bearing points. Positionally stable orientation of the feeder insert is thus advantageously ensured even during the compaction process.

Figure 3A:
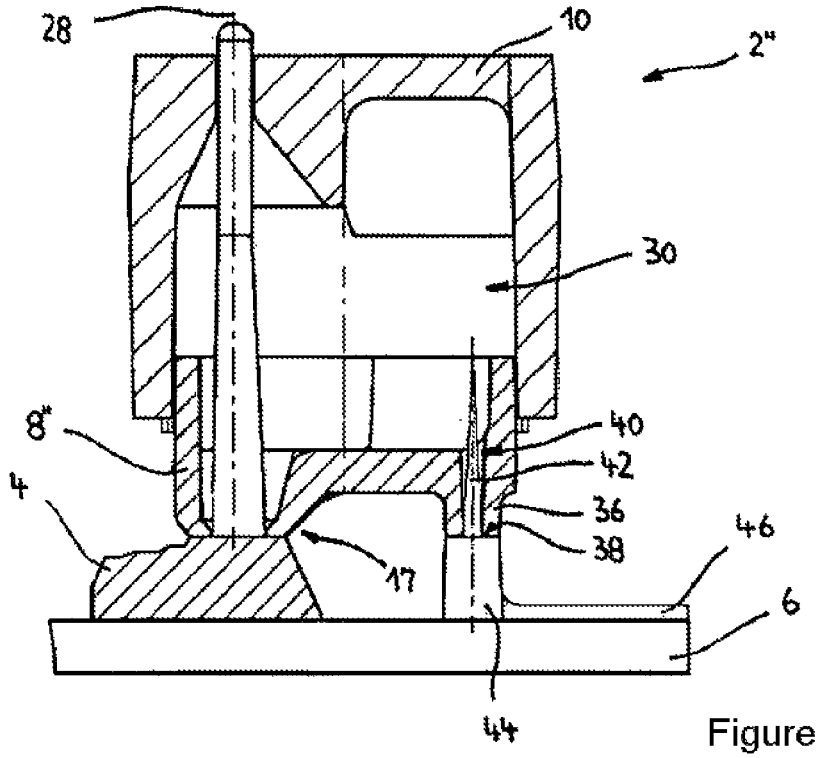
FIGS. 3*a* to 3*c*: show views of a further exemplary embodiment of a feeder insert according to the invention in a longitudinal section.
Figure 3B:
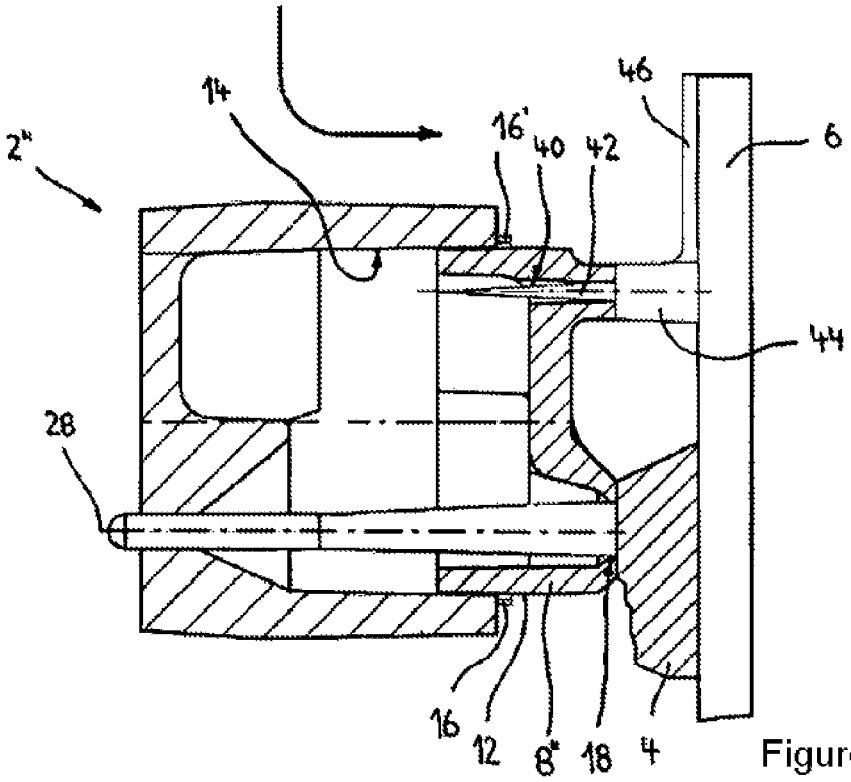

FIG. 3*a* shows a further exemplary embodiment of a feeder insert according to the invention. The feeder insert 2" comprises a first shaped element 8" and a second shaped element 10, which are moveable telescopically relative to one another. The two shaped elements 8", 10 form or delimit the feeder cavity 30 for receiving liquid metal and are designed for being positioned on a centring pin 20, which defines a centring axis 28. In the initial arrangement shown in FIG. 3*a* and also in the two exemplary embodiments discussed above, the first shaped element 8" and the second shaped element 10 are fixed by means of the holding elements 16, 16'. The first shaped element 8", which is mounted by way of its mounting region 17 on the mould pattern 4, has a second opening spaced apart from the passage opening 18, said second opening being a ventilation opening 38 for ventilation from the feeder cavity 30, said ventilation opening extending from the outer side to the inner side of the first shaped element 8" such that a duct 40 is formed. As can be seen from FIG. 3*a*, the duct 40 serves as a centring receptacle for a centring pin 42 which is simultaneously part of a spacer 44 that holds the first shaped element 8" in position relative to the mould plate. On the spacer 44, which is arranged with one end directly on the mould plate 6 and is in contact by way of its other end with a stud or peg 36' of the first shaped element 8", there is formed a means for preventing rotation and securing the position of the feeder insert 2". Accordingly, the feeder insert 2" is fixed relative to the section of the mould pattern 4 or relative to the mould plate 6 during the pivoting of the mould plate 6 into the vertical orientation as illustrated by FIG. 3*b*. In FIG. 3*b*, the feeder insert 2" is still in its initial arrangement relative to the mould plate 6, wherein the feeder cavity 30 has already been oriented such that, in the case of horizontal arrangement of the centring axis, a predominant volume fraction of the feeder cavity is arranged above the centring axis. The region above the centring axis 28 thus forms an adequately large reservoir of liquid metal which can flow in the direction of the passage opening as the casting solidifies. An attachment part 46 is provided on the spacer 44 so as to run parallel to the mould plate and so as to extend in a vertical direction. Together with the spacer 44, the attachment part 46 defines, within the mould material surrounding the feeder insert 2", a space by means of which, after the removal of the mould plate and of the spacer and after the assembly of the vertically separated casting moulds, a cavity for a ventilation function is formed. After the centring pin 42 that projects into the duct 40 is removed, the duct 40, extending parallel to the centring axis 28, in the first shaped element 8" forms an associated further section of the ventilation duct to be produced.

Figure 3C:
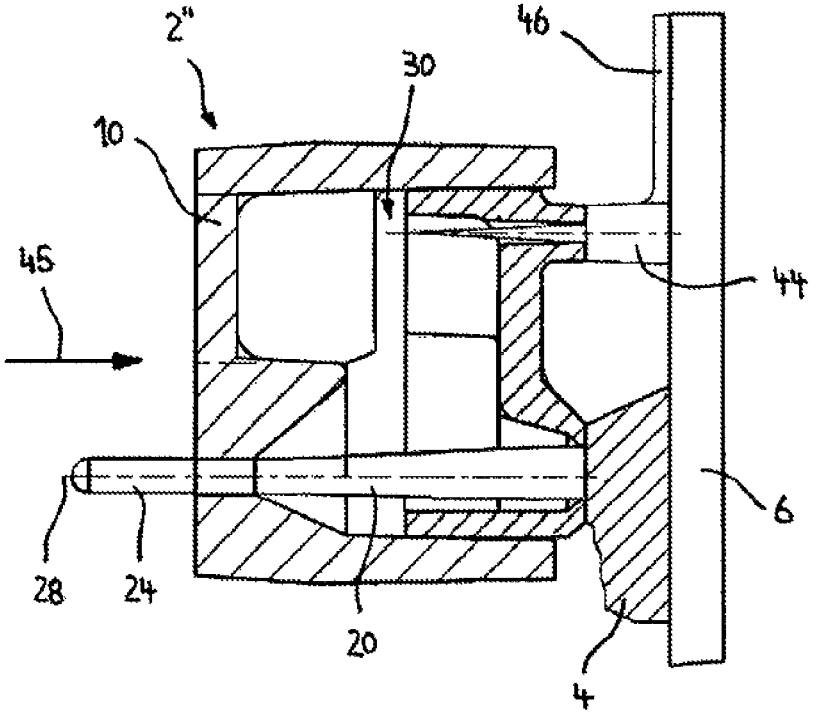

FIG. 3*c* shows the feeder insert 8" according to the invention after the compaction of the mould material, wherein the second shaped element 10 has been moved by way of its guide surface 14 telescopically along a section of the guide surface 12 of the first shaped element 8". The holding elements 16, 16' which are still shown in FIG. 3*b* are no longer arranged on the first shaped element in FIG. 3*c*. Rather, the holding elements 16, 16' which are still shown in FIG. 3*b* are designed such that, when a pressure force acting thereon exceeds a tree determine value, said holding elements are severed or deformed such that a relative movement between the first and second shaped elements 8", 10 is possible. The compaction force (arrow 45) acting parallel to the centring axis 28 and in the direction of the mould plate causes the telescopic movement of the second shaped element 10 over the first shaped element 8", wherein at the same time, the volume of the feeder cavity 30 is reduced. Because the first shaped element 8" is, by means of the spacer 44, fixed in positionally stable fashion with respect to the section of the mould pattern 4 or the mould plate 6, the second shaped element 10 can at all times easily yield to the acting compaction pressure in the direction of the mould plate 6, wherein the holding elements are severed or deformed. The risk of destruction of the feeder insert 2" and of the above-described exemplary embodiments, the first and second shaped elements of which are preferably formed from exothermic feeder material or comprise exothermic feeder material at least in sections, is thus advantageously reduced.

Figure 4:
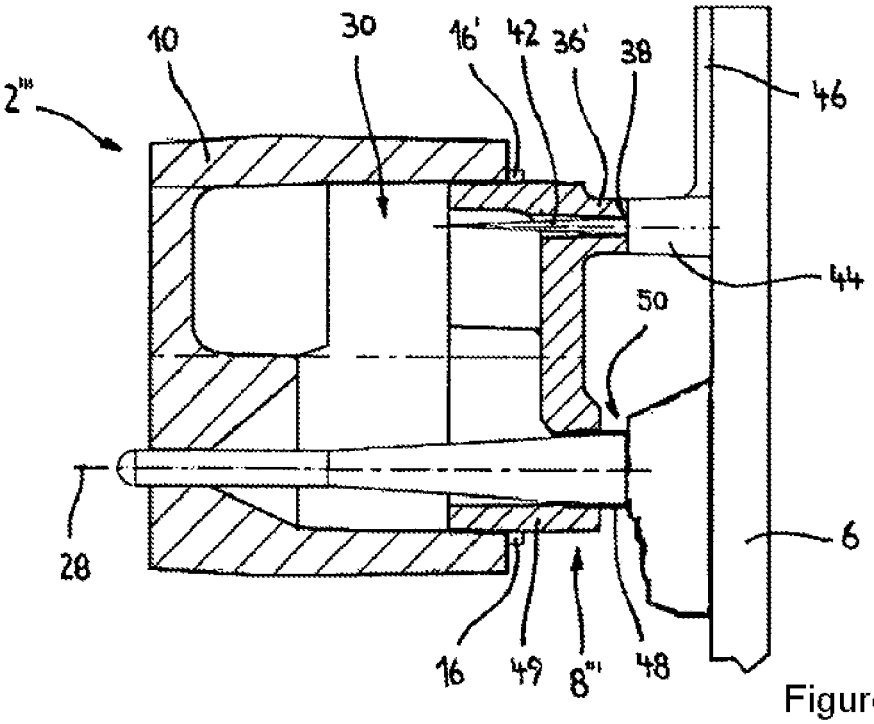
FIG. 4: shows a view of a feeder insert according to the invention with a reduced mounting area on the first shaped element.

FIG. 4 illustrates a feeder insert 2'" whose first shaped element 8'" has, in the manner according to the invention, an eccentrically arranged passage opening 18, such that in the case of horizontal orientation of the centring axis 28, the predominant volume fraction of the feeder cavity 30 is arranged above the centring axis and thus above the passage opening 18. At the same time, the first shaped element is formed in two parts; specifically, the first shaped element 8'" is equipped with a tubular part has a first sub-element 48 for forming a mounting region 50 on the mould pattern 4 with a reduced area of contact with respect to the mould pattern. The tubular part 48 is, as illustrated in FIG. 4, formed so as to be fixed, or in an alternative embodiment of the first shaped element 8'" that is not shown, moveable in the direction of the centring axis 28, with respect to a second sub-element 49 of the first shaped element 8'". Here, the tubular part, as the first sub-element 48 of the first shaped element 8'", forms the footprint surface of the feeder insert (2, 2', 2", 2'"), which constitutes the interface with respect to the mould pattern, and the second sub-element 49 is designed for connection of the tubular part to the second shaped element (10).

In an alternative embodiment of the feeder insert according to the invention, it is the case in particular that the first sub-element of the first shaped element preferably forms a breaker core. This embodiment is advantageous if the material for the first sub-element is composed of a metal or comprises a metallic component.

Figure 5:
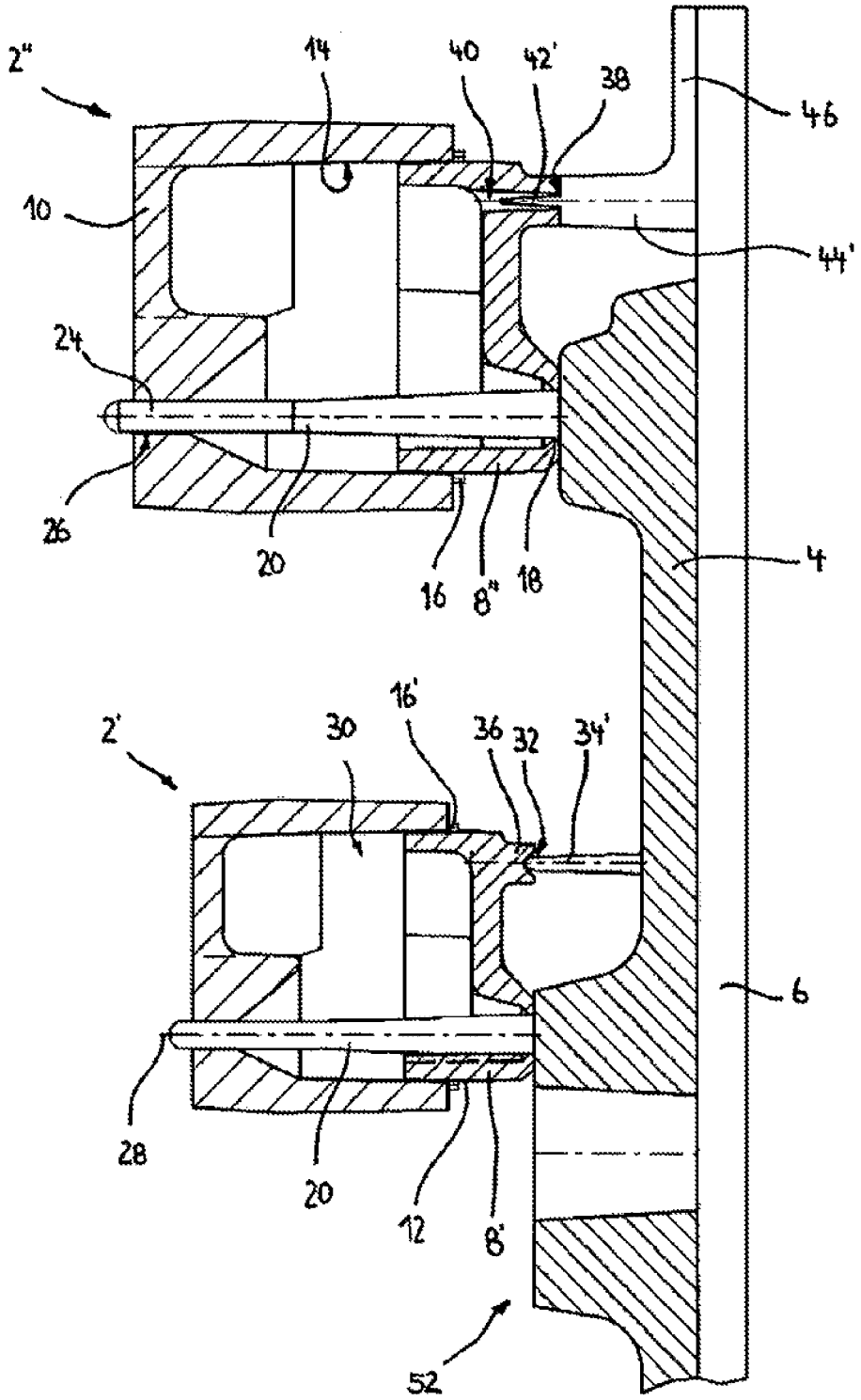
FIG. 5: shows a view of multiple feeder inserts as per FIG. 2 in longitudinal section, arranged on mutually spaced-apart regions of a mould pattern.

FIG. 5 shows the use of multiple feeder inserts on one mould pattern 4, wherein the pivotable mould plate 6 is already illustrated in its vertical orientation. The two feeder inserts 2', 2" are however still in their respective initial position before the compaction of the mould material. By means of the second feeder insert, an optimum supply to at least two regions of the casting mould can be ensured for the purpose of compensating the shrinkage of the casting material during the solidification in these regions. Each of the feeder inserts 2', 2" is pushed by way of its passage opening 18 onto a centring pin 20, and at the same time, a section of the first shaped element 8' is received by way of the second centring pin 34, 42'. The centring pin 34' which supports the feeder insert 2' arranged on the central region 52 of the mould pattern 4 is supported by way of one end on the mould pattern and is in contact by way of its other end with the centring recess 32 in a stand or peg 36 that projects in the direction of the mould plate. The centring pin 42' is part of a spacer 44' which holds the first shaped element 8" in position relative to the mould plate and which projects into the ventilation opening 38, which is in the form of a duct 40. An attachment part 46 is provided on the spacer 44' so as to run parallel to the mould plate and in a vertical direction. Together with the spacer 44', the attachment part 46 defines, within the mould material surrounding the feeder insert 2", a space via which a cavity for a ventilation function is formed after the removal of the mould plate and of the spacer and after the assembly of the mould halves of the vertically separated casting mould. During the casting process, the two feeder inserts are filled and thus, independently of one another, supply of liquid metal to the spaced-apart regions of the casting during the solidification process. Individual shaping of the casting is to be produced is thus possible.

As material for the first shaped elements 8, 8', 8", 8''', depicted in FIGS. 1*a* to 5, use may preferably be made of an exothermic feeder material. Alternatively, to form the first shaped element 8, 8', 8", 8''', use may be made of an insulating feeder material or of some other material selected from the group comprising metals, plastics, cardboards, the mixtures thereof and the composite materials thereof. To form the second shaped element 10, use is made of exothermic or insulating feeder materials, or the second shaped element 10 comprises an exothermic or insulating feeder material at least in sections.

Figure 6A:
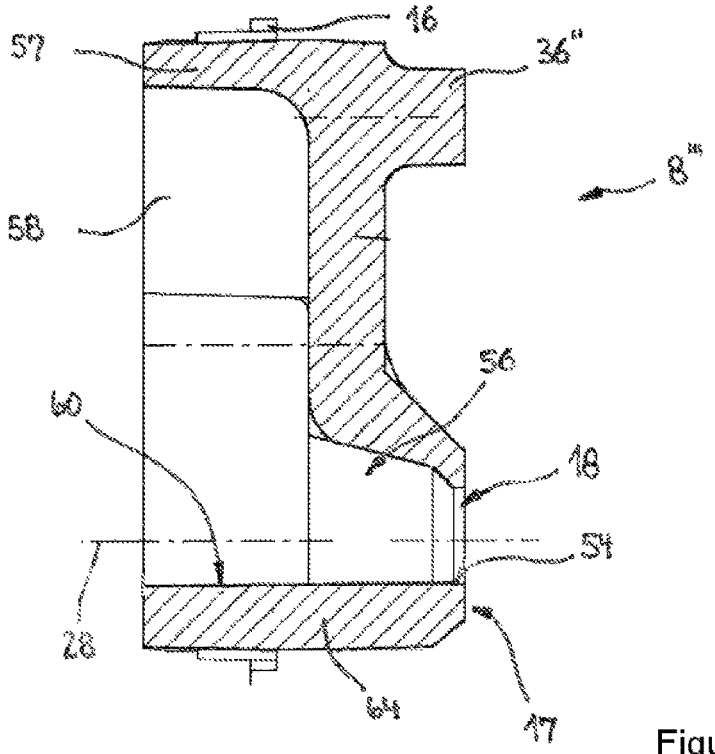
FIGS. 6*a* and 6*b*: show a front, sectional view and a side view of an exemplary embodiment of a first shaped element.
Figure 6B:
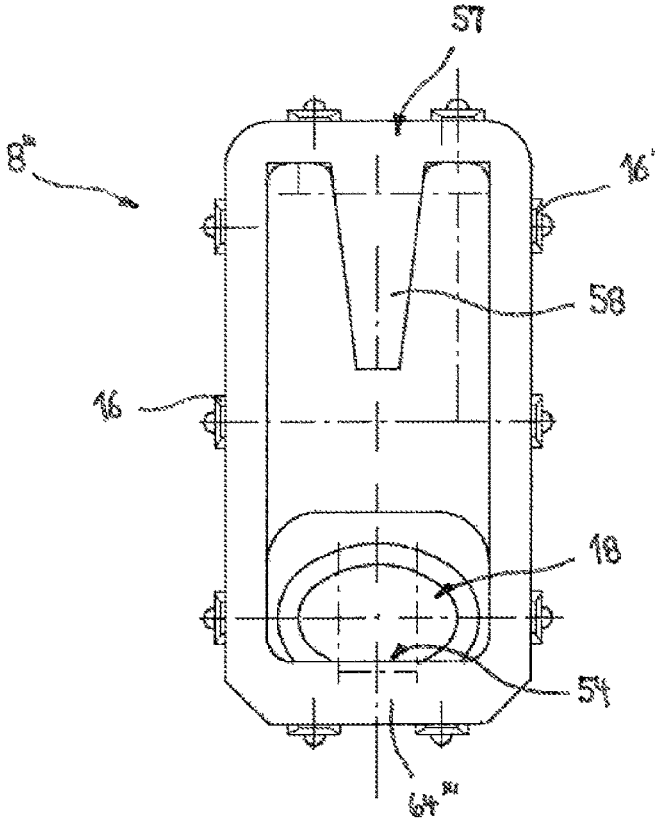

FIGS. 6*a* and 6*b* show a first shaped element 8''' which, like the first shaped elements described above, has a mounting region 17 with a passage opening 18 for the liquid metal, which passage opening serves as a receptacle for a centring pin onto which the first shaped element 8''', together with an associated second shaped element not illustrated here, is pushed. The passage opening 18, as shown in FIG. 6*b*, has a cross section corresponding to an overall that is flattened on one side. Alternative exemplary embodiments of the passage openings are overall or unround or have the shape of a flattened circle or flattened oval or are triangular, tetragonal or polygonal. The centring pin that corresponds with the passage opening 18, in particular the centring pin foot thereof, has a shape that preferably corresponds over the full circumference to the cross section of the passage opening 18, such that a means for preventing rotation of the first shaped element about the centring axis 28, which corresponds to the central axis of the passage opening, is provided by the centring pin itself. The passage opening furthermore has a preferably planar surface section 54. The passage opening 18 is adjoined by an inlet region 56, which widens in a funnel shape in regions, for the liquid metal. The first shaped element 8''' has a rib 58 which, during use, extends vertically from the upper wall 57 in the direction of the centring axis 28, said rib also being referred to as a "Williams strip", by means of which the formation of a skin on the surface of the liquid metal in the feeder cavity is prevented. Arranged on the outer contour of the first shaped element 8''' are the holding elements 16, 16' by means of which the first and second shaped elements are initially held in their initial position relative to one another. The first shaped element 8''' is furthermore equipped, in a region which in the illustration of FIG. 6*a* is arranged above the centring axis, with two cylindrical studs or pegs 36" which project in a vertical direction and by means of which the first shaped element 8''' can be fixed in its position with respect to the mould pattern (not illustrated) or the mould plate. For this purpose, a spacer (not illustrated) is used which produces a connection between a section of the mould pattern or the mould plate and the peg or stud 36". The planar surface section 54 of the passage opening 18 is in this case arranged in alignment with the abutment surface 60 of the first shaped element 8''', which abutment surface is designed for abutment against a corresponding support surface 62 of the central part 74 (FIG. 10) of the centring pin 20. The abutment surface 60 forms the lower wall 64''' of the shaped element during the use of the first shaped element, that is to say in the case of horizontal orientation of the centring axis 28.

Figure 7A:
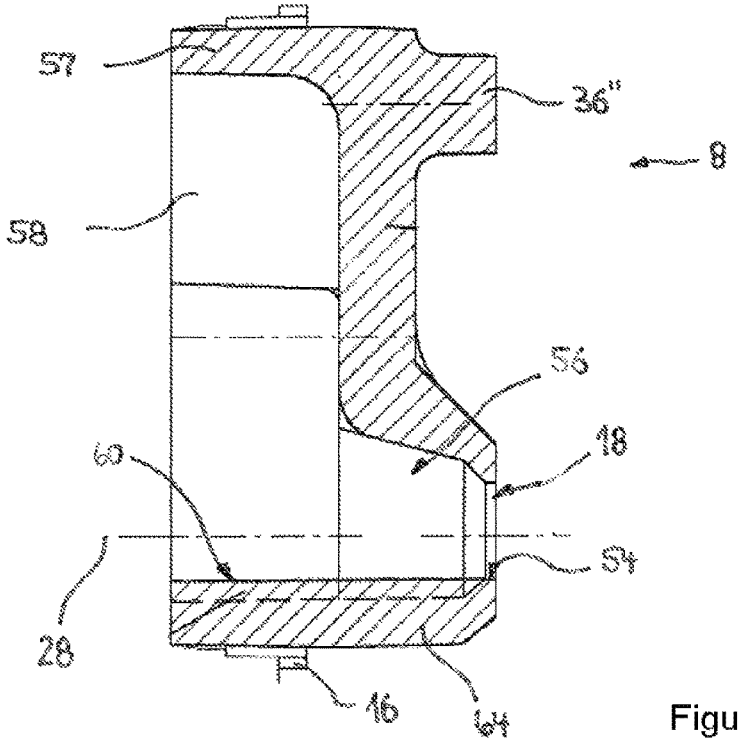
FIGS. 7*a* and 7*b*: show a front, sectional view and a side view of the first shaped element as per FIGS. 1*a* and 1*b;*
Figure 7B:
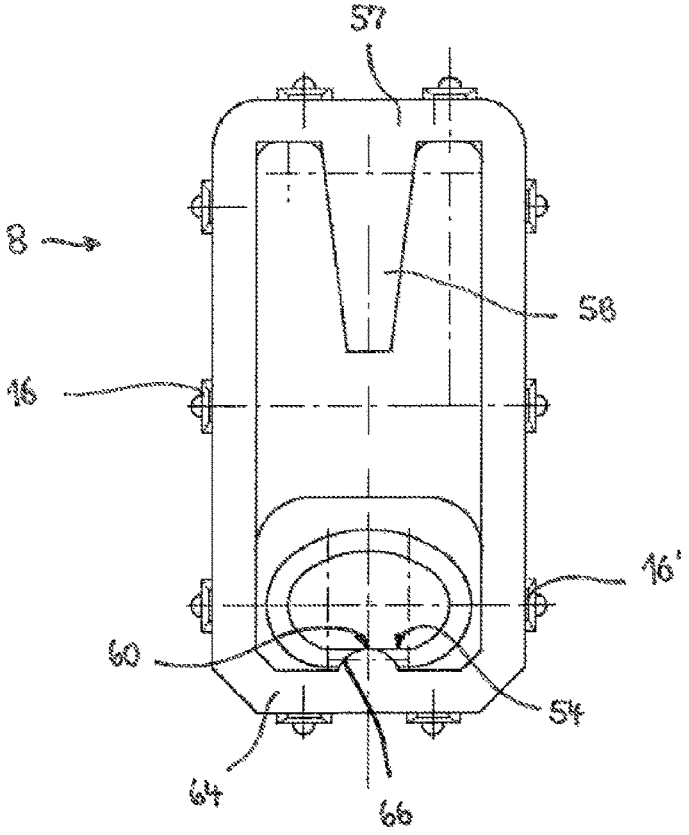

The first shaped element 8 shown in FIGS. 1*a* and 1*b* is shown in a detail view in FIGS. 7*a* and 7*b* in order to illustrate the design thereof. The first shaped element 8 is of similar design to the shaped element 8''' shown in FIG. 6, but differs insofar as the wall 64, which is the lower wall during the use of the first shaped element 8, is not formed so as to be in alignment with the abutment surface 60 of the shaped element 8. An approximately semicircular rib 66 extends from the wall 64, said rib extending in the direction of the centring axis 28 over almost the entire height of the first shaped element 8. Here, a section of the semicircular rib 66 forms an abutment surface 60, which runs in alignment with the planar surface section 54 of the passage opening 18, for support on the centring pin 20. The exemplary embodiment of the first shaped element 8 shown in FIGS. 7*a* and 7*b* has an inlet region 56 which widens in funnel-shaped form, a rib 58 which divides up the feeder cavity into chambers and which runs from the upper wall 57 in the direction of the centring axis 28, and a peg or stud 36" which projects from the outer side in the direction of the mould plate and which serves, in interaction with a corresponding space on the mould plate or on the mould pattern, for fixing the first shaped element in position.

Figure 8A:
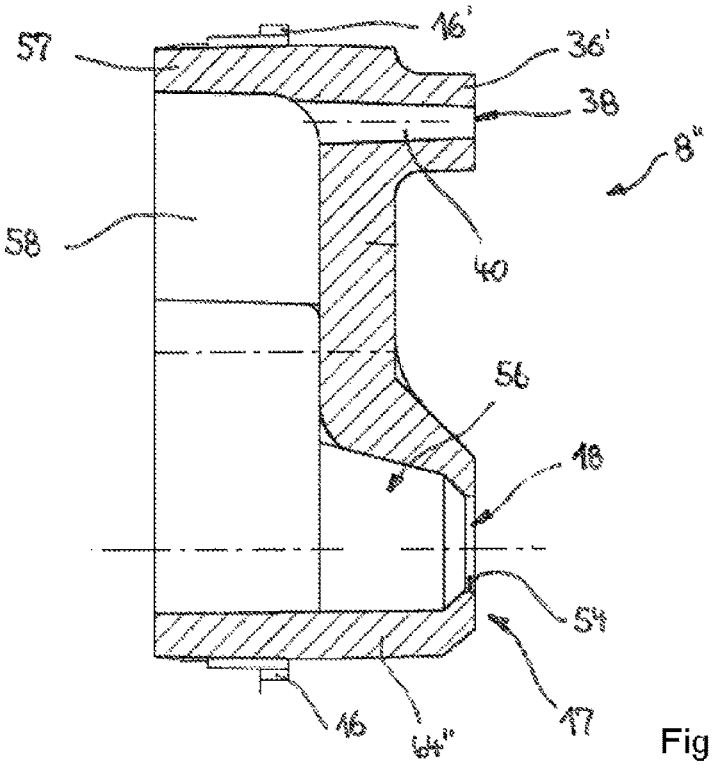
FIGS. 8*a* and 8*b*: show a front, sectional view and a side view of a first shaped element as per FIGS. 3*a* and 3*b;*
Figure 8B:
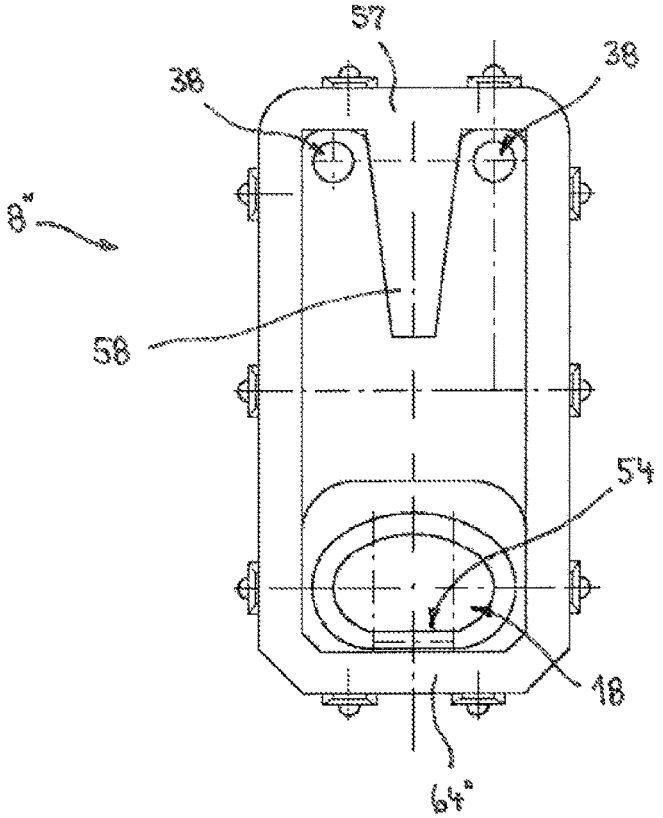

FIGS. 8*a* and 8*b* show, in a detail view, the exemplary embodiment of the first shaped element 8" shown in FIGS. 3*a* to 3*c*, wherein, instead of the abutment surface that corresponds to the support surface 62 of the centring pin, said first shaped element has on its outer side two approximately cylindrical pegs or stud 36' which is point in the direction of the mould pattern 4 or mould plate 6 (FIG. 3*b*). Furthermore, the first shaped element 8" is equipped with two ventilation openings 38 which are formed as ducts 40 running horizontally with respect to the centring axis 28 and which are provided for receiving the centring pin is 34' shown in FIG. 3. The ducts 40 have a cross section which preferably narrows conically from the inner side of the shaped element toward the outer side of the shaped element. The ducts 40, which have the function of ventilation ducts, are formed in the vicinity of the upper wall on the first shaped element 8" during casting operation in the case of horizontal orientation of the centring axis 28. The wall 64", which is the lower wall during use of the first shaped element, is entirely of planar form and runs parallel to the planar surface section 54 of the passage opening 18 formed in the mounting region 17.

Figure 9A:
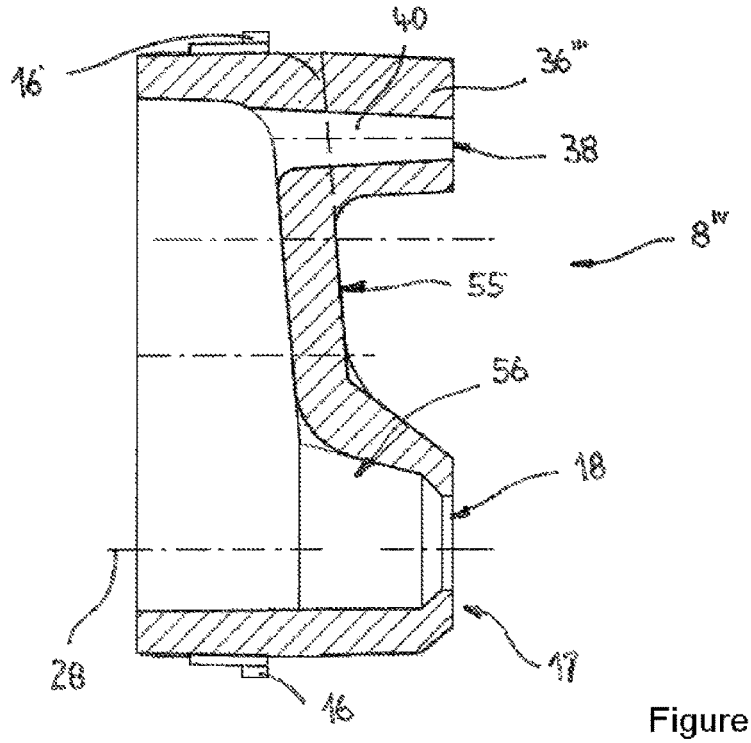
FIGS. 9*a* and 9*b*: show a front, sectional view and a side view of a further exemplary embodiment of a first shaped element.
Figure 9B:
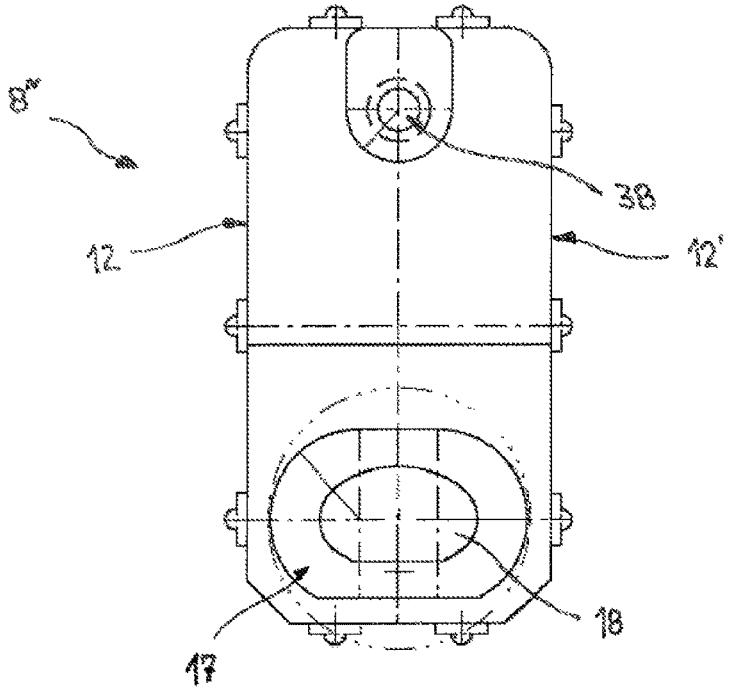
Figure 13A:
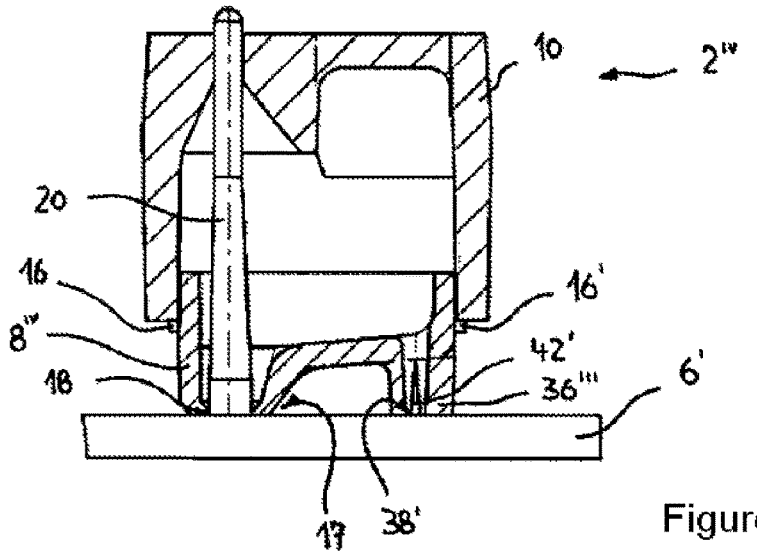
Figure 13B:
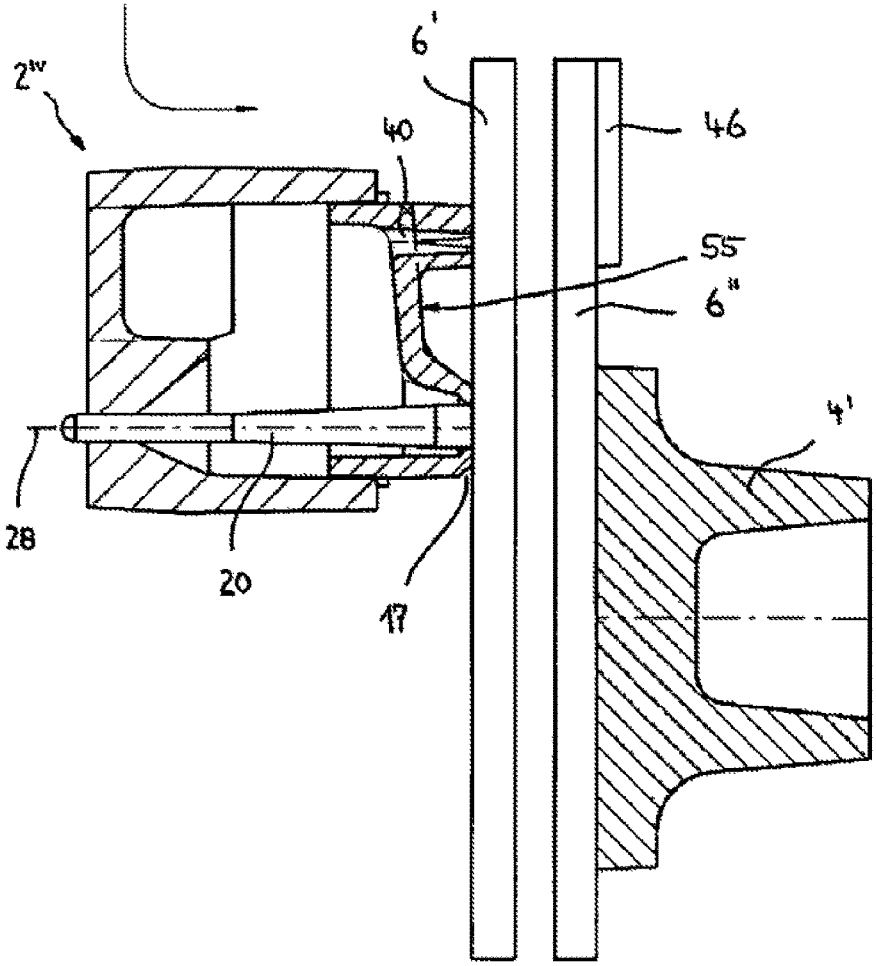
Figure 14:
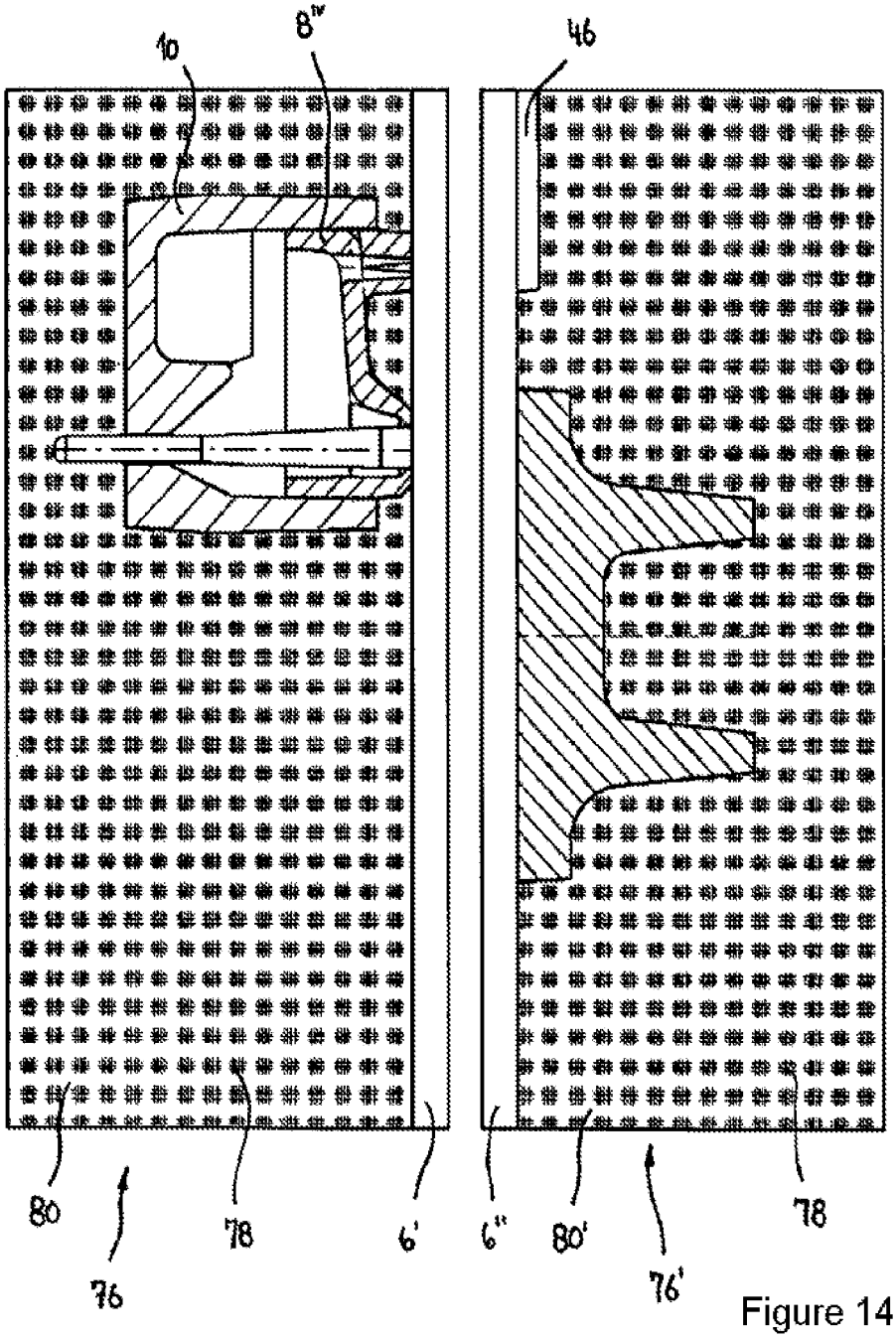
Figure 15:
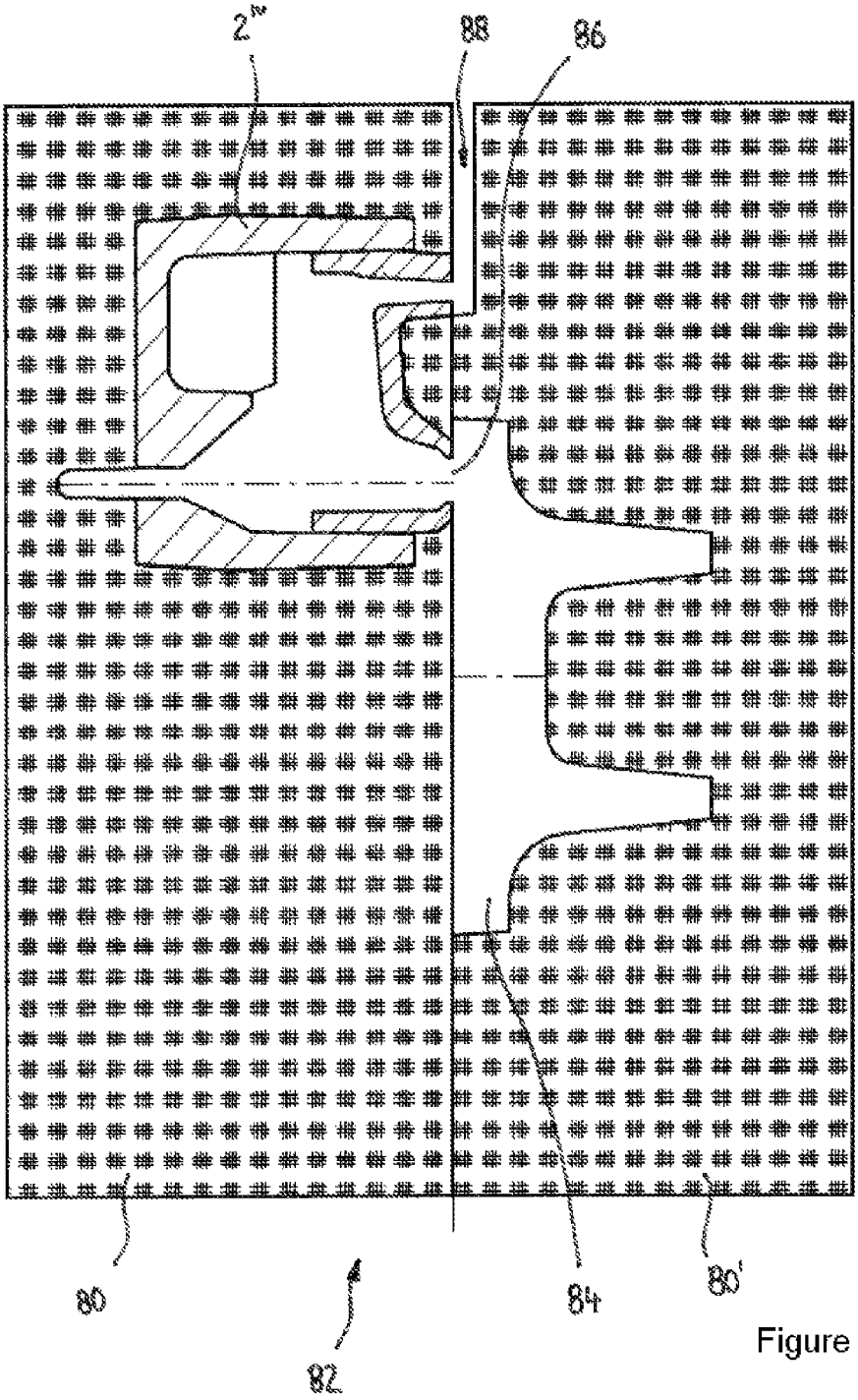

A further alternative exemplary embodiment of a first shaped element $8^{IV}$ according to the invention is shown in FIGS. 9*a* and 9*b*. The shaped element $8^{IV}$ has only a single stud or peg 36''' instead of the two pegs or studs of the exemplary embodiments shown above. The stud or peg 36''' is arranged on that side of the first shaped element $8^{IV}$ which points in the direction of the mould pattern 4 or of the pivotable mould plate 6 (FIG. 13*a*). The stud 36''' has an oval cross section and, as shown in FIG. 9*b*, is arranged approximately equidistantly from the two lateral guide surfaces 12, 12' of the first shaped element $8^{IV}$. Furthermore, on the stud or peg 36''', there is provided a ventilation opening 38' which is in the form of a duct 40' running parallel to the centring axis 28. The duct 40 for ventilation from the feeder cavity furthermore has a cross section which narrows conically from the inner side of the shaped element $8^{IV}$ in the direction of the outer side of the shaped elements. By contrast to the exemplary embodiments shown above, the first shaped element $8^{IV}$ does not have a rib that divides up the feeder cavity into chambers. On the side facing toward the mould pattern 4 or the pivotable mould plate, there is formed between the mounting region 17 and the stud or peg 36''' a surface 55 which has an inclination or is of oblique form. Here, the distance between the mould pattern or mould plate and the oblique surface 55 of the first shaped element $8^{IV}$ increases uniformly in the direction of the ventilation opening 38' proceeding from the centring axis 28. The first shaped element 8$^{IV}$, like the exemplary embodiments of the first shaped element shown above, likewise has an inlet region 56 which widens in a funnel shape downstream of the throughflow opening 18.

As material for forming the first shaped elements 8", 8''', 8$^{IV}$ depicted in FIGS. 6*a* to 9*b*, use is preferably made of an exothermic feeder material. In an alternative embodiment of the feeder insert according to the invention, to form the first shaped element 8", 8''', 8$^{IV}$, use is made of an insulating feeder material or of some other material preferably selected from the group comprising metals, plastics, cardboards, the mixtures thereof and the composite materials thereof.

Figure 10A:
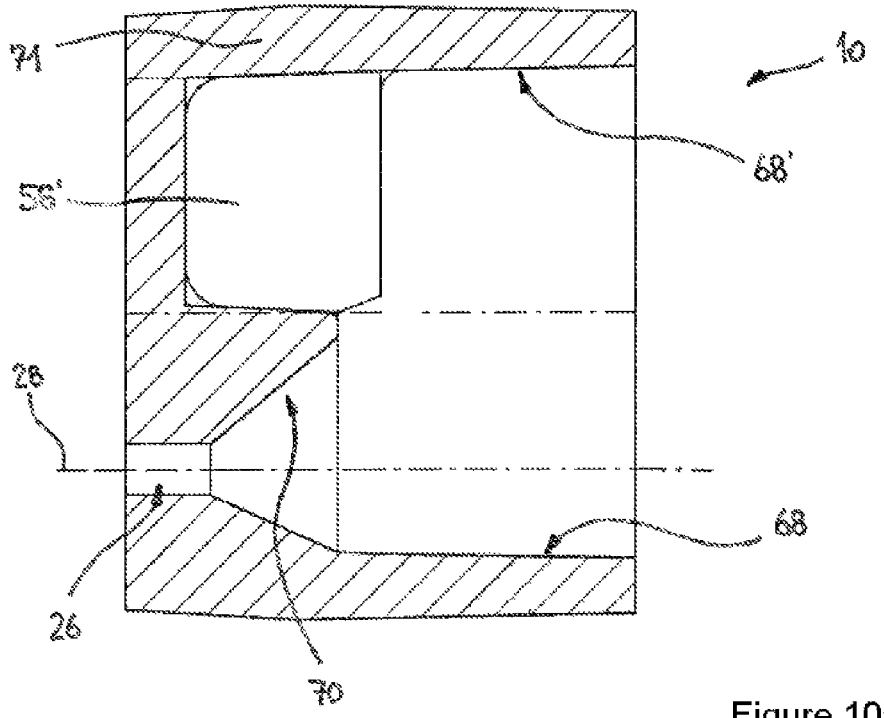
FIGS. 10*a* and 10*b*: show views of a second shaped element according to the invention in section and from the side.
Figure 10B:
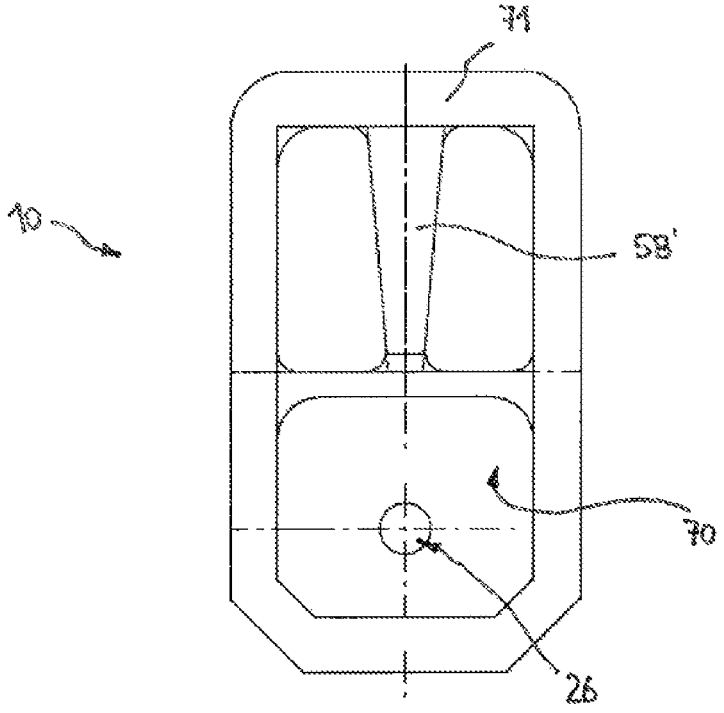

FIGS. 10*a* and 10*b* illustrate a second shaped element for forming the feeder insert according to the invention, wherein inner wall surfaces 68, 68' that form the inner contour of the second shaped element run, in sections, parallel to one another and parallel to the centring axis 28. The second shaped element 10 furthermore has, on an inner wall region, a conically running wall section 70 and a cylindrical (or alternatively non-cylindrical) recess 26 which, in particular, adjoins the conically running wall section 70. The recess 26 is, in terms of its dimensions, in particular coordinated with the external dimensions of a centring pin tip 24 (FIG. 10) that corresponds to the recess. The second shaped element 10 likewise has a rib 58' which, during use of the shaped element, extends vertically from the upper wall 71 of the shaped element in the direction of the centring axis 28 and which likewise divides up the interior of the second shaped element into chambers. The rib 58' likewise has the function of a Williams strip. To form the second shaped element shown in FIGS. 10*a* and 10*b*, use is made of exothermic or insulating feeder materials, or the second shaped element 10 comprises an exothermic or insulating feeder material at least in sections.

Figure 11A:
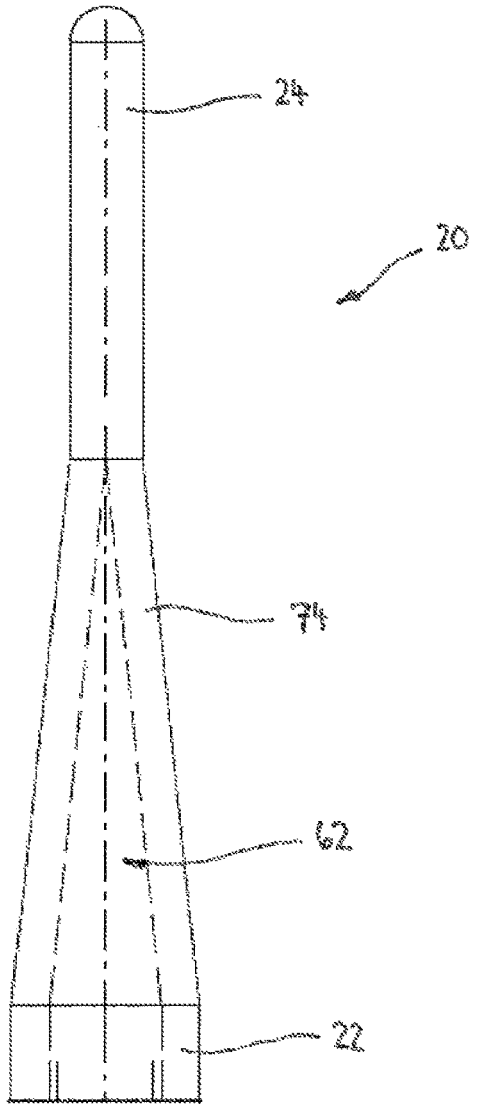
FIGS. 11*a* and 11*b*: show a front view and a plan view of a centring pin corresponding to the feeder insert according to the invention.
Figure 11B:
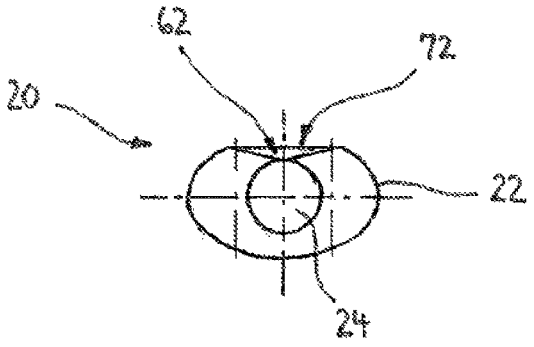

FIGS. 11*a* and 11*b* show views of a centring pin 20 which is part of a kit according to the invention, said kit being composed of feeder insert designed according to the invention and the centring pin corresponding to the feeder insert. The centring pin 20 has a centring pin foot 22 and a centring pin tip 24, wherein the centring pin tip is of cylindrical form and is of hemispherical form at the end. The centring pin foot 22 has an oval basic shape, wherein the centring pin foot has, with regard to its primary axes running perpendicular to the central axis, a diameter which is in a ratio in the range between 1.5 and 2.5 with respect to the diameter of the centring pin tip. The centring pin foot 22 is furthermore flattened on one side and has a planar surface 72 which corresponds to the planar surface section 54 of the first shaped element 8 to 8''' (FIGS. 1 to 8). A preferred mounting orientation of the respectively used feeder insert on the centring pin 20 is predefined by means of the planar surface 72, whereby incorrect mounting of the feeder insert on the centring pin is prevented. The centring pin tip 24 and centring pin foot 22 are coupled by means of an approximately conically running central part 74 which provides a gradual transition from the centring pin foot 22 to the centring pin tip 24. The planar surface 72 formed on one side in the region of the centring pin foot 22 forms, together with a planar surface along the central part 74 of the centring pin 20, the support surface 62. The support surface 62 comes into direct contact, at least in sections, with the abutment surface 60 of the first shaped element 8, 8', 8''', whereby it is ensured that the feeder inserts 2, 2', 2''' pushed onto the centring pin 20 are optimally fixed in position during the compaction of the mould material. The first shaped element and/or the second shaped element each have a width extending parallel to a central axis which runs vertically during use of the feeder insert, and each have a depth extending perpendicular thereto, wherein the width of the two shaped elements is in each case in a ratio in the range from 1.7 to 2.3 with respect to the depth of the two shaped elements.

Figure 12A:
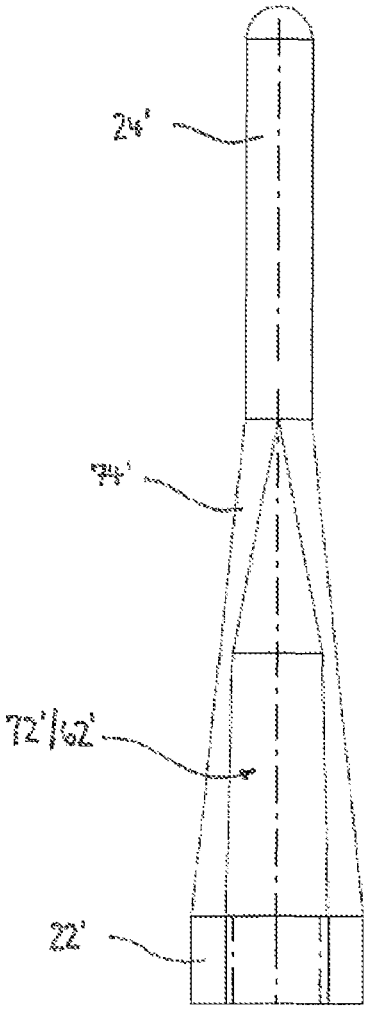
FIGS. 12*a*, 12*b* and 12*c*: show a front view, a side view and a plan view of a further exemplary embodiment of a centring pin according to the invention, and FIGS. 13*a* to 15, in sectional illustrations, schematically show the production of a casting mould from the mounting of a feeder insert according to the invention onto a pivotable mould plate to the assembly of the mould halves produced to form a casting mould.
Figure 12B:
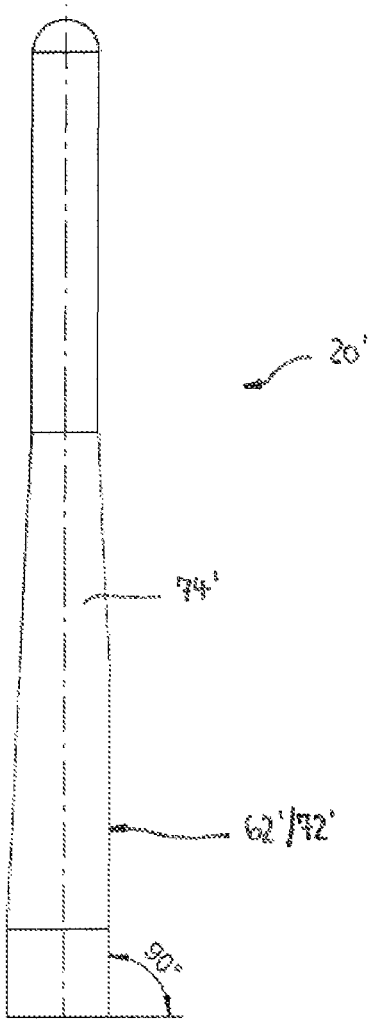
Figure 12C:
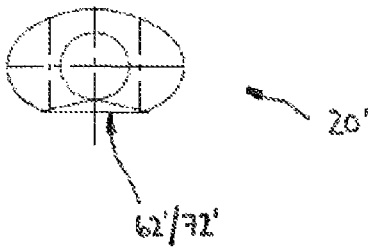

FIGS. 12*a* to 12*c* show an alternative embodiment of a centring pin 20' according to the invention which is alternatively part of a kit according to the invention, said kit being composed of a feeder insert designed according to the invention and the centring pin corresponding to the feeder insert. The centring pin 20' has a centring pin foot 22', a centring pin tip 24' and a substantially conically running central part 74'. The centring pin 20' has, on one side in the region of the centring pin foot 22, a planar surface 72' which, in this exemplary embodiment according to the invention, extends from the centring pin foot 22' over half of the central part 74'. Said planar surface 72', which runs in particular at right angles to the surface by which the centring pin stands on the mould pattern or on the pivotable mould plate, has a support surface 62' with which the abutment surface 60 of the first shaped element 8, 8', 8''' can be brought into direct contact.

When the feeder insert 2, 2', 2", 2''' according to the invention is mounted on the mould pattern 4 or on the pattern plate 6 situated in a horizontal orientation (FIGS. 1*a*, 2*a*, 3*a*, 4), wherein the feeder insert 2, 2', 2", 2''' is pushed by way of its first shaped element 8, 8', 8", 8''' and the second shaped element 10 onto the centring pin 20, the first shaped element 8, 8', 8", 8''' is brought into contact with the mould pattern 4 such that the passage opening 18 in the first shaped element 8, 8', 8", 8''' is completely covered by regions of the mould pattern 4. Not illustrated is the alternative embodiment in which the passage opening 18 is covered by surface regions of the pivotable mould plate 6. Subsequently, the mould plate 6 with the mould pattern 4 and the feeder insert 2, 2', 2", 2''' arranged thereon are pivoted to an angle of approximately 90°, such that the mould plate 6 is in a vertical orientation (FIGS. 1*b*, 2*b*, 3*b*, 5). A rotationally fixed orientation with respect to the mould pattern is ensured by means of the shaped elements 8, 8', 8", 8''' designed according to the invention and the centring pin 20 corresponding thereto. Then, in the vertical orientation, mould material is poured in (not shown a more detail) on at least that side of the mould plate on which the feeder insert 2, 2', 2", 2''' is arranged, such that the first shaped element 8, 8', 8", 8''' and the second shaped element 10 of the feeder insert 2, 2', 2", 2''' are virtually completely encased by mould material. The mould material surrounding the feeder insert 2, 2', 2", 2''' is compacted, and during the compaction, predominantly a pressure force (arrow 45, FIG. 3*c*) acts on the feeder insert 2, 2', 2", 2''' in the direction of the centring axis 28. When the pressure force reaches a sufficient value, the holding elements 16, 16' on the first shaped element 8, 8', 8", 8''' are severed or deformed such that the shaped elements can be moved telescopically relative to one another, wherein the second shaped element 10 is, in sections, pushed over the first shaped element 8, 8', 8", 8''' and, at the same/time, reduces the volume of the feeder cavity 30. During the movement process, the first shaped element 8, 8', 8", 8''' does not change its position relative to the mould pattern 4 or the mould plate 6. After the compaction, the mould half that is produced is separated from the mould plate 6, the mould pattern 4 and the centring pin 20, such that one or more feeder inserts 2, 2', 2", 2''' remain in the mould half that is produced. If the feeder insert 2" has a ventilation opening 38 for ventilating the feeder insert 2" and if so attachment parts 46 connected to the spacer 44 are provided on the mould plate, then after the removal of the pivotable mould plate 6, a ventilation duct is produced within the mould half, via which ventilation duct air can escape from the feeder cavity during the casting process.

FIGS. 13*a* to 15 show an alternative embodiment of a method for producing a casting, wherein a feeder insert $\mathbf{2}^{IV}$ designed according to the invention is pushed or mounted by way of its passage opening 18, and by way of the ventilation opening 38' in the first shaped element $\mathbf{8}^{IV}$, onto two centring pins 20, 42' that are arranged on a first mould plate 6'. In the process, the feeder insert $\mathbf{2}^{IV}$ comes into direct contact, by way of its mounting region 17 and the stud or peg 36''', with the first mould plate 6', which at this time is in a horizontal orientation. The first shaped element $\mathbf{8}^{IV}$ and the second shaped element 10 are fixed in their initial position relative to one another by means of the holding elements 16, 16'. Subsequently, the first mould plate 6' is pivoted into the vertical orientation (FIG. 13*b*) such that the centring axis 28 of the feeder insert $\mathbf{2}^{IV}$ passes into the horizontal orientation and the first mould plate 6' is oriented parallel to a second mould plate 6''. In this exemplary embodiment, only the feeder insert $\mathbf{2}^{IV}$ is attached onto the first mould plate 6'. The mould pattern 4' and an attachment part 46' provided for forming a ventilation duct are arranged on the second mould plate 6''. As can be seen from FIG. 14, after the two mould plates 6' and 6'' have been oriented parallel to one another, chambers 76, 76' are produced around the mould plates, into which chambers a mould material 78 is then poured. After the filling of the chambers 76, 76', the mould material 78 is then compressed, and thus compacted, in the chambers. During the compaction of the mould material, the second shaped element 10 is moved telescopically over the first shaped element $\mathbf{8}^{IV}$, such that the overall height of the feeder insert $\mathbf{2}^{IV}$ is reduced considerably in relation to the overall height in the initial position (FIG. 13*a*). Owing to a surface 55 of the first shaped element $\mathbf{8}^{IV}$ being formed obliquely with respect to the first mould plate 6' (FIG. 13*b*), it is ensured that the region between the surface of the first mould plate 6' and the first shaped element $\mathbf{8}^{IV}$ is adequately filled with mould material during the pouring of mould material into the chambers 76, 76', and the desired mould material compaction around the mounting region 17 is achieved during the compaction process. With the compaction of the mould material 78, firm mould halves 80, 80' for the casting mould are produced in each of the chambers, which mould halves can be assembled to form a casting mould 82, cf. FIG. 15, after the first and second mould plates 6', 6'', and thus simultaneously the mould pattern 4' and the attachment part 46', have been removed. The casting mould 82 that is produced has a cavity 84 for the liquid metal to be poured into the casting mould, which cavity substantially corresponds to the shape of the casting to be produced. The cavity 84 has a transition 86 to the feeder insert $\mathbf{2}^{IV}$ in the first mould half 80. A ventilation duct 88 that corresponds with the ventilation opening 38' in the first shaped element $\mathbf{8}^{IV}$ of the feeder insert according to the invention is formed in the casting mould 82, by means of which ventilation duct it can advantageously be ensured that the feeder insert $\mathbf{2}^{IV}$ is virtually completely filled with liquid metal during casting operation, such that the supply of liquid metal during the shrinkage of the metal in the cavity of the casting mould 82 can be ensured. The ventilation duct 88 (FIG. 15) is arranged where the attachment part 46' was arranged previously (cf. FIG. 13*b*, 14).

In the appended figures, identical components are denoted by the same reference signs.

The invention claimed is:

1. A feeder insert for a metal casting mould, comprising a first shaped element and a second shaped element, wherein the first and second shaped elements:

(i) are moveable telescopically relative to one another, (ii) delimit a feeder cavity for receiving liquid metal, and (iii) are configured for a centring pin that can be positioned along a centring axis, wherein the first shaped element comprises a passage opening for the liquid metal, wherein the casting mould is vertically separable, and wherein when the centring axis is horizontally arranged, a predominant volume fraction of the feeder cavity is positioned above the centring axis.

2. The feeder insert according to claim 1, further comprising a conically running wall section and/or a cylindrical or non-cylindrical recess for a pin tip on the second shaped element.

3. The feeder insert according to claim 1, further comprising a ventilation opening for ventilating the feeder cavity on the first shaped element, wherein the ventilation opening is positioned above the centring axis when the centring axis is horizontally arranged.

4. The feeder insert according to claim 3, wherein the ventilation opening comprises a ventilation duct, wherein the ventilation duct runs parallel to the centring axis.

5. The feeder insert according to claim 1, wherein (i) the second shaped element comprises an exothermic feeder material, and/or the first shaped element comprises an exothermic feeder material, or (ii) the second shaped element comprises an insulating feeder material, and/or the first shaped element comprises an insulating feeder material, or (iii) the second shaped element comprises an exothermic feeder material, and/or the first shaped element does not comprise an exothermic feeder material and comprises an insulating feeder material or a material selected from the group consisting of metals, plastics, cardboards, mixtures thereof, and composite materials thereof, or (iv) the second shaped element comprises an insulating feeder material, and/or the first shaped element comprises an exothermic feeder material or a material selected from the group consisting of metals, plastics, cardboards, mixtures thereof, and composite materials thereof.

6. The feeder insert according to claim 1, wherein the first shaped element is one piece or is composed of an assembly of a first and second sub-elements which are positionally stable relative to one another or moveable telescopically relative to one another, wherein the first sub-element comprises a footprint surface of the feeder insert and the second sub-element is designed for connecting to the second shaped element.

7. The feeder insert according to claim 1, further comprising holding elements for holding the first shaped element and the second shaped element in an initial position, wherein the holding elements are configured to be severed or deformed during a telescopic movement.

8. The feeder insert according to claim 1, wherein the first shaped element comprises external surface sections which adjoin or bear against internal surface sections of the second shaped element and are configured to prevent or impede lateral tilting of the first shaped element relative to the second shaped element during a telescopic movement of the shaped elements.

9. The feeder insert according to claim 1, wherein the first shaped element comprises a passage opening with a non-circular cross section selected from the group consisting of oval, unround, flattened circle, flattened oval, triangular, tetragonal and polygonal, and/or one or more recesses or openings for receiving a second centring pin, wherein the one or more recesses or openings run parallel to the centring axis, and/or one or more spacers on the side facing toward the mould plate.

10. The feeder insert according to claim 1, wherein the second shaped element comprises one or more integrally formed ribs or wall sections on the inside at its end situated opposite the passage opening which divide up the feeder cavity into chambers.

11. A kit for producing the feeder insert, said kit comprising the first shaped element and the second shaped element as defined in claim 1.

12. The kit according to claim 11, further comprising the centring pin for positively locking the feeder insert.

13. A method for casting metal in an installation with pivotable mould plate, comprising the following steps:

placing the feeder insert according to claim 1 on a mould pattern with a centring pin wherein the mould pattern is arranged on the pivotable mould plate, or directly on the pivotable mould plate with centring pin;

pivoting the mould plate with the feeder insert arranged thereon such that a centring axis for the feeder insert is horizontally oriented and, wherein a predominant volume fraction of the feeder cavity is positioned above the centring axis.

* * * * *